US011566371B2

(12) United States Patent
Yoshimaru et al.

(10) Patent No.: US 11,566,371 B2
(45) **Date of Patent: *Jan. 31, 2023**

(54) STRANDED CONDUCTOR AND METHOD FOR MANUFACTURING STRANDED CONDUCTOR

(71) Applicants: FURUKAWA ELECTRIC CO., LTD., Tokyo (JP); FURUKAWA AUTOMOTIVE SYSTEMS INC., Inukami-gun (JP)

(72) Inventors: Masahiro Yoshimaru, Inukami-gun (JP); Hideyuki Osuga, Inukami-gun (JP)

(73) Assignees: FURUKAWA ELECTRIC CO., LTD., Tokyo (JP); FURUKAWA AUTOMOTIVE SYSTEMS INC., Inukami-gun (JP)

( * ) Notice: Subject to any disclaimer, the term of this patent is extended or adjusted under 35 U.S.C. 154(b) by 255 days.

This patent is subject to a terminal disclaimer.

(21) Appl. No.: 16/593,002

(22) Filed: Oct. 4, 2019

(65) Prior Publication Data

US 2020/0032453 A1 Jan. 30, 2020

Related U.S. Application Data

(63) Continuation of application No. 15/982,375, filed on May 17, 2018, now Pat. No. 10,458,064, which is a (Continued)

(30) Foreign Application Priority Data

Nov. 17, 2015 (JP) ..... JP2015-224565

(51) Int. Cl.
*D07B 1/06* (2006.01)
*H01B 5/08* (2006.01)

(Continued)

(52) U.S. Cl.
CPC ..... *D07B 1/0693* (2013.01); *D07B 1/06* (2013.01); *D07B 1/08* (2013.01); *D07B 1/147* (2013.01);

(Continued)

(58) Field of Classification Search
CPC ..... H01B 5/102; H01B 13/0228; H01B 13/0833; H01B 17/12; H01B 5/08;

(Continued)

(56) References Cited

U.S. PATENT DOCUMENTS 2,075,996 A * 4/1937 Noyes ..... H01B 5/104 57/220
3,029,590 A * 4/1962 Caroselli ..... F16G 5/06 57/251

(Continued)

FOREIGN PATENT DOCUMENTS

CN 101002288 A 7/2007
CN 101069245 A 11/2007

(Continued)

OTHER PUBLICATIONS

Japanese Office Action dated Apr. 16, 2020 in Patent Application No. 2017-551934 (with English translation), 11 pages.

(Continued)

*Primary Examiner* — Krystal Robinson
(74) *Attorney, Agent, or Firm* — Oblon, McClelland, Maier & Neustadt, L.L.P.

(57) ABSTRACT

According to embodiments of the present invention, a stranded conductor is formed in which the occurrence of defects, such as strand unevenness of filaments and outward protrusion of filaments, is inhibited. According to embodiments of the present invention, a stranded conductor (1*a*) includes soft filaments (2*a*) stranded together. The soft filaments (2*a*) include a soft filament made of an aluminum (Continued)

material, disposed along a center (101), and include six soft filaments, twelve soft filaments, and eighteen soft filaments made of an aluminum material, disposed around and concentrically with the center. The filaments are softened filaments that are softened. A lay length (Pa) is from 6.2 times to 15.7 times a conductor diameter of the stranded conductor.

20 Claims, 17 Drawing Sheets

Related U.S. Application Data continuation of application No. PCT/JP2016/084172, filed on Nov. 17, 2016.

(51) Int. Cl.

| | |
|---|---|
| ***H01B 13/02*** | (2006.01) |
| ***D07B 1/14*** | (2006.01) |
| ***H01B 1/02*** | (2006.01) |
| ***D07B 1/08*** | (2006.01) |
| *D07B 3/02* | (2006.01) |

(52) U.S. Cl.

CPC ..... *H01B 1/023* (2013.01); *H01B 5/08* (2013.01); *H01B 13/02* (2013.01); *H01B 13/0221* (2013.01); *D07B 3/02* (2013.01); *D07B 2201/204* (2013.01); *D07B 2201/2025* (2013.01); *D07B 2201/2031* (2013.01); *D07B 2201/2059* (2013.01); *D07B 2205/306* (2013.01); *D07B 2207/4045* (2013.01); *D07B 2501/406* (2013.01); *H01B 13/0285* (2013.01)

(58) Field of Classification Search

CPC ..... H02G 7/056; H02G 1/04; H02G 7/053; H02G 7/10; F16G 11/12

See application file for complete search history.

(56) References Cited

U.S. PATENT DOCUMENTS

| | | | | |
|---|---|---|---|---|
| 3,231,665 | A * | 1/1966 | Grimes, Jr. | H01B 7/041 174/128.1 |
| 3,496,285 | A * | 2/1970 | Slethei | H02G 7/14 174/42 |
| 3,666,879 | A * | 5/1972 | Hirsch | H01B 7/14 174/128.1 |
| 3,813,481 | A * | 5/1974 | Adams | H01B 5/104 174/128.1 |
| 4,696,542 | A * | 9/1987 | Thompson | G02B 6/4427 385/108 |
| 4,697,875 | A * | 10/1987 | Priaroggia | G02B 6/4416 385/101 |
| 5,243,137 | A * | 9/1993 | Gentry | H01B 13/0285 174/128.1 |
| 5,952,614 | A * | 9/1999 | Ries | H01B 12/08 174/128.1 |
| 9,027,235 | B2 | 5/2015 | Eichelmann | |
| 10,020,094 | B2 * | 7/2018 | Lancaster | H01B 5/102 |
| 2009/0211784 | A1 | 8/2009 | Grogl et al. | |
| 2010/0038112 | A1 * | 2/2010 | Grether | H01B 5/105 174/128.1 |
| 2010/0059249 | A1 * | 3/2010 | Powers | H01B 1/023 174/128.1 |
| 2011/0036614 | A1 | 2/2011 | Otsuka et al. | |
| 2012/0261158 | A1 * | 10/2012 | Daniel | H01B 3/427 174/102 R |
| 2013/0255840 | A1 | 10/2013 | Otsuka et al. | |
| 2013/0333916 | A1 | 12/2013 | Matsuno et al. | |
| 2014/0251653 | A1 * | 9/2014 | Lancaster | H01B 5/102 174/128.1 |
| 2015/0318080 | A1 * | 11/2015 | Mekala | D07B 1/147 174/128.1 |

FOREIGN PATENT DOCUMENTS

| | | | |
|---|---|---|---|
| CN | 101783213 | A | 7/2010 |
| CN | 101828240 | A | 9/2010 |
| CN | 102124528 | A | 7/2011 |
| CN | 103077781 | A | 5/2013 |
| CN | 103140900 | A | 6/2013 |
| CN | 103403812 | A | 11/2013 |
| CN | 204143888 | U | 2/2015 |
| CN | 104766680 | A | 7/2015 |
| DE | 10 2008 027 295 | B4 | 5/2010 |
| JP | 3014931 | U | 8/1995 |
| JP | 7-282633 | | 10/1995 |
| JP | 2009-54410 | A | 3/2009 |
| JP | 2012-182000 | | 9/2012 |
| JP | 2014-207130 | | 10/2014 |
| WO | WO 2009/054457 | A1 | 4/2009 |

OTHER PUBLICATIONS

Office Action dated Dec. 3, 2019 in Chinese Patent Application No. 201680066633 (with English translation).

Chinese Office Action dated Jul. 13, 2020 in Chinese Patent Application No. 201680066633.X (with English machine translation), 11 pages.

German Office Action dated Dec. 15, 2020 in German Patent Application No. 112016005261.8 (with English machine translation), 29 pages.

Japanese Office Action dated Oct. 5, 2021 in Japanese Patent Application No. 2020-126255 (with English translation), 8 pages.

Combined Chinese Office Action and Search Report dated Feb. 17, 2022 in Patent Application No. 202011440392.5 (with English language translation), 26 pages.

International Search Report dated Jan. 17, 2017 in PCT/JP2016/084172, filed on Nov. 17, 2016 (with English Translation).

Office Action dated Mar. 19, 2019 in corresponding Chinese Patent Application No. 201680066633.X, filed Nov. 17, 2016 (with English-language Translation), 18 pages.

Office Action dated Oct. 27, 2022 in Chinese Patent Application No. 202011440392.5 (with English-language Translation), 12 pages.

* cited by examiner

1a···STRANDED CONDUCTOR
11a···INNER LAYER PORTION
12a···OUTERMOST LAYER
101···CENTER
2a···SOFT FILAMENTS

1d···STRANDED CONDUCTOR
11d···INNER LAYER PORTION
12d···OUTERMOST LAYER
101···CENTER
2a···SOFT FILAMENTS
Φd2···CONDUCTOR DIAMETER
P1···INNER LAYER LAY LENGTH
P2···OUTER LAYER LAY LENGTH

STRANDED CONDUCTOR AND METHOD FOR MANUFACTURING STRANDED CONDUCTOR

CROSS-REFERENCE TO RELATED APPLICATIONS

The present application is a Continuation of U.S. patent application Ser. No. 15/982,375, filed May 17, 2018, the entire contents of which are incorporated herein by reference. U.S. patent application Ser. No. 15/982,375 is a Bypass Continuation of International Application No. PCT/JP2016/084172, filed Nov. 17, 2016, which is based upon and claims the benefit of priority to Japanese Applications No. 2015-224565, filed Nov. 17, 2015. The present application claims the benefit of priority to Japanese Patent Application No. 2015-224565, International Application No. PCT/JP2016/084172, and U.S. patent application Ser. No. 15/982,375.

TECHNICAL FIELD

This invention relates to a stranded conductor formed of aluminum filaments stranded together and a method for manufacturing the stranded conductor.

BACKGROUND ART

Vehicles, such as automobiles, include a wire harness installed therein for connecting electronic devices together to send and receive signals and supply power, for example. The wire harness is formed of insulated electrical wires, which are conductors each covered with an insulating covering, and connectors that can be connected to, for example, electronic devices.

An example of an insulated electrical wire, which is a constituent of such a wire harness, is disclosed in Patent document 1, for example. In Patent Document 1, the insulated electrical wire is formed of a core wire (hereinafter referred to as a stranded conductor), an insulating covering, and a lubricant. The stranded conductor is formed by a radial multi-layer structure including nineteen aluminum filaments stranded together, the insulating covering covers the stranded conductor, and the lubricant is applied between the stranded conductor and the insulating covering.

With the stranded conductor of multi-layer structure disclosed in Patent document 1, there is a possibility that, depending on the lay length with which filaments are stranded together, strand unevenness of filaments to be stranded together may occur, and filaments disposed radially inward of the outermost layer, that is, disposed in the inner portion, may protrude outward.

Specifically, for example, in the case that the lay length is short, the angle of the filaments to be stranded together, with respect to the central axis of the stranded conductor, is large, and as a result, strand unevenness may occur in the filaments. On the other hand, in the case that the lay length is long, the central axis and the filaments are nearly parallel to each other, and as a result, filaments disposed in the inner portion may protrude outward from the outermost layer.

CITATION LIST

Patent Literature

Patent Document 1: JP 2014-207130 A

SUMMARY OF INVENTION

Technical Problem

Accordingly, embodiments of the present invention are directed toward providing a desired stranded conductor and method for manufacturing the stranded conductor. In the stranded conductor, occurrence of defects, such as strand unevenness of filaments and outward protrusion of filaments, is inhibited.

Solution to Problem

An aspect of this invention is a stranded conductor including filaments stranded together. The filaments are made of an aluminum material and are identical to one another. The filaments include a filament disposed along a center of the stranded conductor, six filaments disposed around and concentrically with the center, twelve filaments disposed around and concentrically with the center, and eighteen filaments disposed around and concentrically with the center. The filaments are softened filaments that are softened. A lay length is from 6.2 times to 15.7 times a conductor diameter of the stranded conductor.

The concept of the above-described filament made of an aluminum material is as follows. Examples of the filament include filaments made of a pure aluminum-based material having a composition corresponding to that of JIS H4000 1070, filaments made of a high-strength aluminum alloy material containing magnesium and silicon added thereto and having an improved tensile strength compared with that of a pure aluminum-based material having a composition corresponding to that of JIS H4000 1070, and filaments made of another aluminum alloy material.

The concept of the above-described conductor diameter is as follows. The conductor diameter is the diameter of a stranded conductor formed of filaments stranded together and corresponds to the diameter of the outermost layer, which is formed of filaments disposed on the outermost side.

The lay length is a length in the axial direction necessary for rotating filaments to be stranded together 360 degrees about the central axis of the stranded conductor.

By an aspect of this invention, a desired stranded conductor is formed in which the occurrence of defects, such as strand unevenness of softened filaments and outward protrusion of softened filaments, is inhibited, even in the case that thirty-seven softened filaments are stranded together.

Specifically, in a case where the lay length is smaller than 6.2 times the conductor diameter, the angle of the softened filaments to be stranded together, with respect to the central axis of the stranded conductor, is large, and as a result, strand unevenness may occur in the softened filaments.

On the other hand, in a case where the lay length is larger than 15.7 times the conductor diameter, the twist length per pitch of the outermost layer, which is formed of softened filaments disposed on the outermost side, is long. Thus, the twisting load of the outermost layer that acts on the inner layer portion, which is formed of softened filaments disposed radially inward of the outermost layer, is dispersed, that is, the twisting load that acts on the inner layer portion decreases. Also, the softened filaments that form the outermost layer are nearly parallel to the central axis of the stranded conductor. As a result, softened filaments that form the inner layer portion may protrude outward from between softened filaments that form the outermost layer.

In contrast, by configuring the lay length to be from 6.2 times to 15.7 times the conductor diameter, the softened filaments can be stranded together at a desired angle with respect to the central axis of the stranded conductor, and also, the twisting load of the outermost layer that acts on the inner layer portion can be a desired twisting load. As a result, the occurrence of strand unevenness of softened filaments is inhibited, and outward protrusion of softened filaments that form the inner layer portion from between softened filaments that form the outermost layer is inhibited.

Consequently, a desired stranded conductor is formed. It is more preferable that the lay length be from 8.7 times to 14.8 times the conductor diameter. This produces a more noticeable effect.

Another aspect of this invention is a stranded conductor including filaments stranded together. The filaments are made of an aluminum material and identical to one another. The filaments include a filament disposed along a center of the stranded conductor and a predetermined number of filaments disposed around concentrically with the center. The filaments are softened filaments that are softened. The lay length is from 6.4 times to 22.0 times the conductor diameter.

By the aspect of this invention, a desired stranded conductor is formed in which the occurrence of defects, such as strand unevenness of filaments and outward protrusion of filaments, is inhibited, even in the case that nineteen filaments are stranded together.

In an embodiment of the aspect of this invention, the filaments may be unsoftened filaments that are unsoftened, and the lay length may be from 6.4 times to 16.9 times the conductor diameter.

By the embodiment of the aspect of this invention, a stranded conductor is formed in which the occurrence of defects, such as strand unevenness of unsoftened filaments and outward protrusion of unsoftened filaments, is reliably prevented, even in the case that nineteen unsoftened filaments, harder than softened filaments, are stranded together.

It is more preferable that the lay length be from 9.6 times to 15.4 times the conductor diameter. This produces a more noticeable effect.

In another embodiment of the aspect of this invention, the filaments may be softened filaments that are softened, and the lay length may be from 8.6 times to 22.0 times the conductor diameter.

By the embodiment of an aspect of this invention, a stranded conductor is formed in which the occurrence of defects, such as strand unevenness of softened filaments and outward protrusion of softened filaments, is reliably prevented, even in the case that nineteen softened filaments are stranded together.

It is more preferable that the lay length be from 12.1 times to 20.7 times the conductor diameter. This produces a more noticeable effect.

In another embodiment of an aspect of this invention, the stranded conductor may serve as an inner layer portion, and an outermost layer may be formed of eighteen of the filaments, disposed outside of and concentrically with the inner layer portion. An outer layer lay length with which the outermost layer is stranded may be from 6.8 times to 22.7 times the conductor diameter. An inner layer lay length of the inner layer portion in a state in which the outermost layer is formed may be a value determined by Equation (1) below.

[Equation 1]

$$P3 = \frac{P1 \times P2}{P1 + P2} \tag{1}$$

In Equation (1), P1 represents an inner layer lay length prior to formation of the outermost layer, P2 represents the outer layer lay length, and P3 represents the inner layer lay length in the state in which the outermost layer is formed.

By the embodiment of the aspect of this invention, the occurrence of defects, such as strand unevenness of softened filaments and outward protrusion of softened filaments, is prevented, even in the case that an outermost layer formed of eighteen softened filaments is stranded on the outside of an inner layer portion formed of nineteen softened filaments.

Furthermore, when the outermost layer is being stranded, the twisting load acts on the inner layer portion. As a result, the inner layer lay length is changed to a lay length different from the outer layer lay length. Thus, the stranding is accomplished in such a manner that the softened filaments that form the inner layer portion intersect the softened filaments that form the outermost layer. Consequently, defects, such as outward protrusion of softened filaments, are more reliably prevented.

Thus, a desired stranded conductor is formed. It is more preferable that the outer layer lay length be from 7.5 times to 18.2 times the conductor diameter. This produces a more noticeable effect.

Another aspect of this invention is a method for manufacturing a stranded conductor, the stranded conductor including filaments made of an aluminum material and identical to one another. The filaments include a filament disposed along a center of the stranded conductor, six aluminum filaments stranded around and concentrically with the center, twelve aluminum filaments stranded around and concentrically with the center, and eighteen aluminum filaments stranded around and concentrically with the center. The method includes the steps of (a) softening the filaments and (b) stranding together the filaments, the steps being performed in the order stated. In step (b), a lay length is set to from 6.2 times to 15.7 times a conductor diameter of the stranded conductor and a tension from 1.0 N to 4.5 N is applied to the filaments.

The concept of the above-described step of softening the filaments is as follows. Examples of the step include a step in which filaments made of a pure aluminum-based material having a composition corresponding to that of JIS H4000 1070 is softened by being exposed to an elevated temperature of 350° C. for five hours in a state in which the filaments are wound on bobbins or are unwound, to thereby form softened filaments. The step is not limited to being exposed to an elevated temperature of approximately 350° C. for five hours.

According to an aspect of this invention, a stranded conductor is formed in which stranding is accomplished with a predetermined lay length without slackening, even in the case that thirty-seven softened filaments are stranded together.

Specifically, in a case where a tension of less than 1.0 N is applied to the softened filaments or no tension is applied to the softened filaments to carry out stranding, slackening may occur in the softened filaments to be stranded together or slackening may occur in the stranded conductor formed by the stranding.

On the other hand, in a case where a tension of greater than 4.5 N is applied to the softened filaments to carry out stranding, the softened filaments to be stranded together may become elongated or broken.

In contrast, by applying a tension from 1.0 N to 4.5 N to the softened filaments to carry out stranding, the occurrence of slackening in the softened filaments to be stranded together or in the stranded conductor obtained by the stranding is prevented, and also, elongation or breakage of the softened filaments is prevented.

Thus, the softened filaments can be stranded together with a predetermined lay length without slackening. As a result, a desired stranded conductor is formed in which the occurrence of defects, such as strand unevenness of softened filaments and outward protrusion of softened filaments, is prevented.

Another aspect of this invention is a method for manufacturing a stranded conductor, the stranded conductor including filaments made of an aluminum material and identical to one another. The filaments include a filament disposed along a center of the stranded conductor and a predetermined number of filaments stranded around and concentrically with the center. The method includes the step of (c) stranding six of the filaments and twelve of the filaments, disposed around and concentrically with the center. In step (c), a lay length is set to from 6.4 times to 22.0 times a conductor diameter of the stranded conductor and a tension from 1.0 N to 7.0 N is applied to the filaments.

By the aspect of this invention, filaments can be stranded together with a predetermined lay length without slackening, even in the case that nineteen filaments are stranded together. As a result, a desired stranded conductor is formed in which the occurrence of defects, such as strand unevenness of filaments and outward protrusion of filaments, is prevented.

In an embodiment of the aspect of this invention, in step (c), the lay length may be set to from 6.4 times to 16.9 times the conductor diameter and a tension from 5.0 N to 7.0 N may be applied to the filaments, and after step (c), the step of (d) softening the filaments may be performed.

By the embodiment of the aspect of this invention, unsoftened filaments can be stranded together with a predetermined lay length without slackening, even in the case that nineteen unsoftened filaments, harder than softened filaments, are stranded together. As a result, a desired stranded conductor is formed in which the occurrence of defects, such as strand unevenness of unsoftened filaments and outward protrusion of unsoftened filaments, is prevented.

Moreover, by performing the step of softening the filaments after the step of stranding together the filaments, rather than performing the step of softening the nineteen filaments before being stranded together, in other words, by performing the step of softening on the stranded conductor obtained by the stranding, the treatment length can be shortened. As a result, for example, the softening facility can be reduced in size, for example.

In another embodiment of the aspect of this invention, step (c) may be performed after step (d), and in step (c), the lay length may be set to from 8.6 times to 22.0 times the conductor diameter and a tension from 1.0 N to 4.5 N may be applied to the filaments.

By the embodiment of the aspect of this invention, the softened filaments can be stranded together with a predetermined lay length without slackening, even in the case that nineteen softened filaments are stranded together. As a result, a desired stranded conductor is formed in which the occurrence of defects, such as strand unevenness of softened filaments and outward protrusion of softened filaments, is prevented.

In another embodiment of an aspect of this invention, the stranded conductor described above may serve as an inner layer portion and step (c) may include the steps of: (c1) stranding the inner layer portion; and (c2) stranding an outermost layer formed of eighteen of the filaments, disposed outside of and concentrically with the inner layer portion, the steps being performed in the order stated. In step (c2), an outer layer lay length with which the outermost layer is to be stranded may be set to from 6.8 times to 22.7 times the conductor diameter and a tension from 1.0 N to 4.5 N may be applied to the filaments and a tension from 20 N to 150 N may be applied to the inner layer portion.

By the embodiment of the aspect of this invention, softened filaments that form an outermost layer can be stranded together with a predetermined outer layer lay length without slackening, even in the case that an outermost layer formed of eighteen softened filaments is stranded on the outside of an inner layer portion formed of nineteen softened filaments. As a result, a desired stranded conductor is formed in which the occurrence of defects, such as strand unevenness of softened filaments and outward protrusion of softened filaments, is prevented.

Specifically, in a case where a tension of less than 20 N is applied to the inner layer portion or no tension is applied to the inner layer portion to carry out stranding, slackening may occur in the inner layer portion.

On the other hand, in a case where a tension of greater than 150 N is applied to the inner layer portion to carry out stranding, the filaments that form the inner layer portion may become elongated or broken.

Further, in a case where a tension of less than 1.0 N is applied to the softened filaments or no tension is applied to the softened filaments to carry out stranding, slackening may occur in softened filaments that form the outermost layer and outward protrusion of softened filaments that form the inner layer portion may occur.

On the other hand, in a case where a tension of greater than 4.5 N is applied to the softened filaments to carry out stranding, the softened filaments may become elongated or broken.

In contrast, by applying a tension from 20 N to 150 N to the inner layer portion and applying a tension from 1.0 N to 4.5 N to the softened filaments to carry out stranding, the softened filaments that form the outermost layer can be stranded on the inner layer portion, which is in a properly tensioned state, with a predetermined outer layer lay length without slackening. In addition, elongation or breakage of the softened filaments that form the inner layer portion and the softened filaments that form the outermost layer is prevented.

Consequently, a desired stranded conductor is formed in which the occurrence of defects, such as strand unevenness of softened filaments and outward protrusion of softened filaments, is prevented.

Advantageous Effects of Invention

Embodiments of the present invention provide desired stranded conductors in which the occurrence of defects, such as outward protrusion of filaments and formation of strand unevenness of filaments, is inhibited, and also provide methods for manufacturing such stranded conductors.

DESCRIPTION OF EMBODIMENTS

First Embodiment

A first embodiment of this invention will be described with reference to FIGS. 1 to 6.

Figure 1:
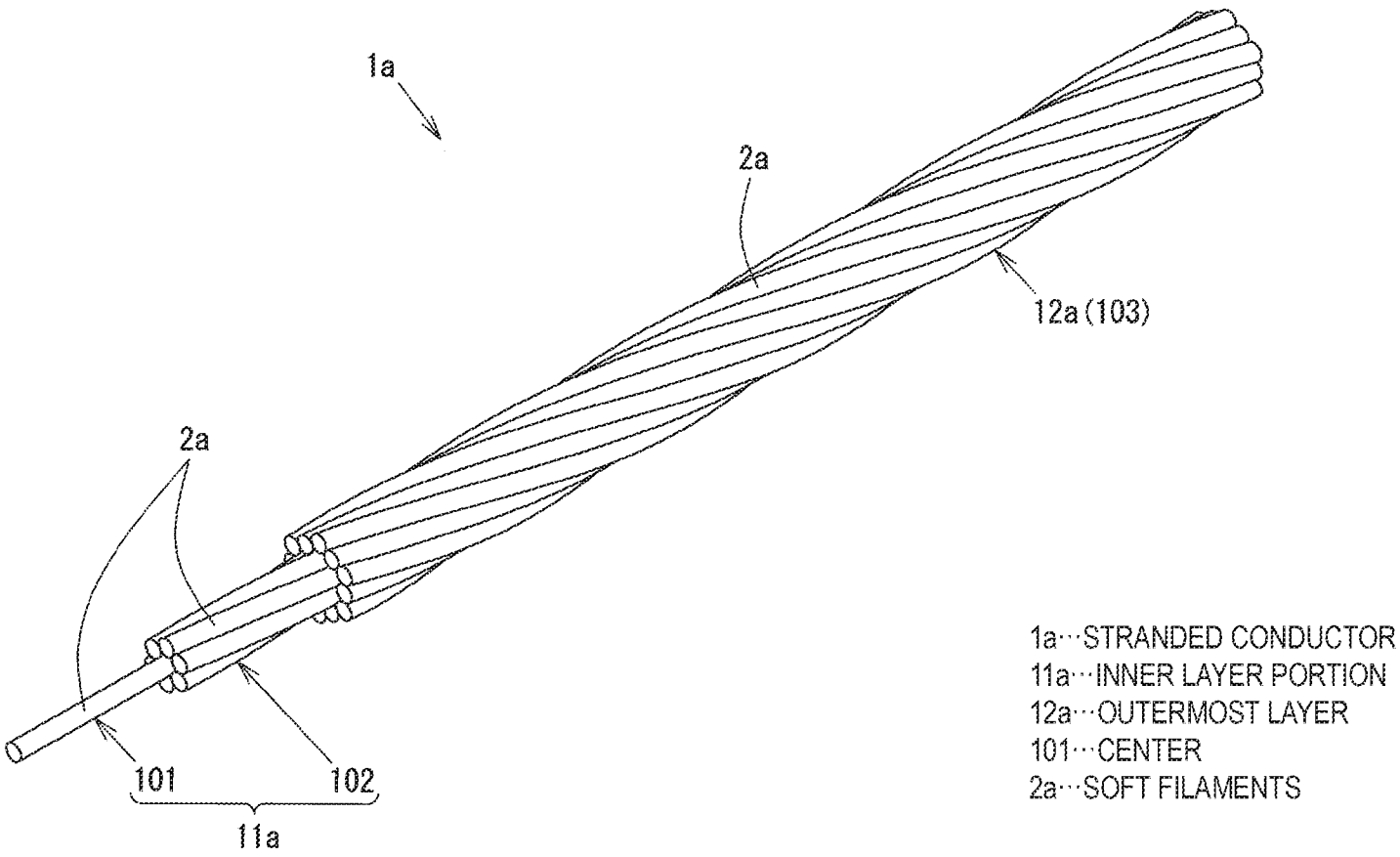
FIG. 1 is a perspective view of a stranded conductor according to a first embodiment.
Figure 2:
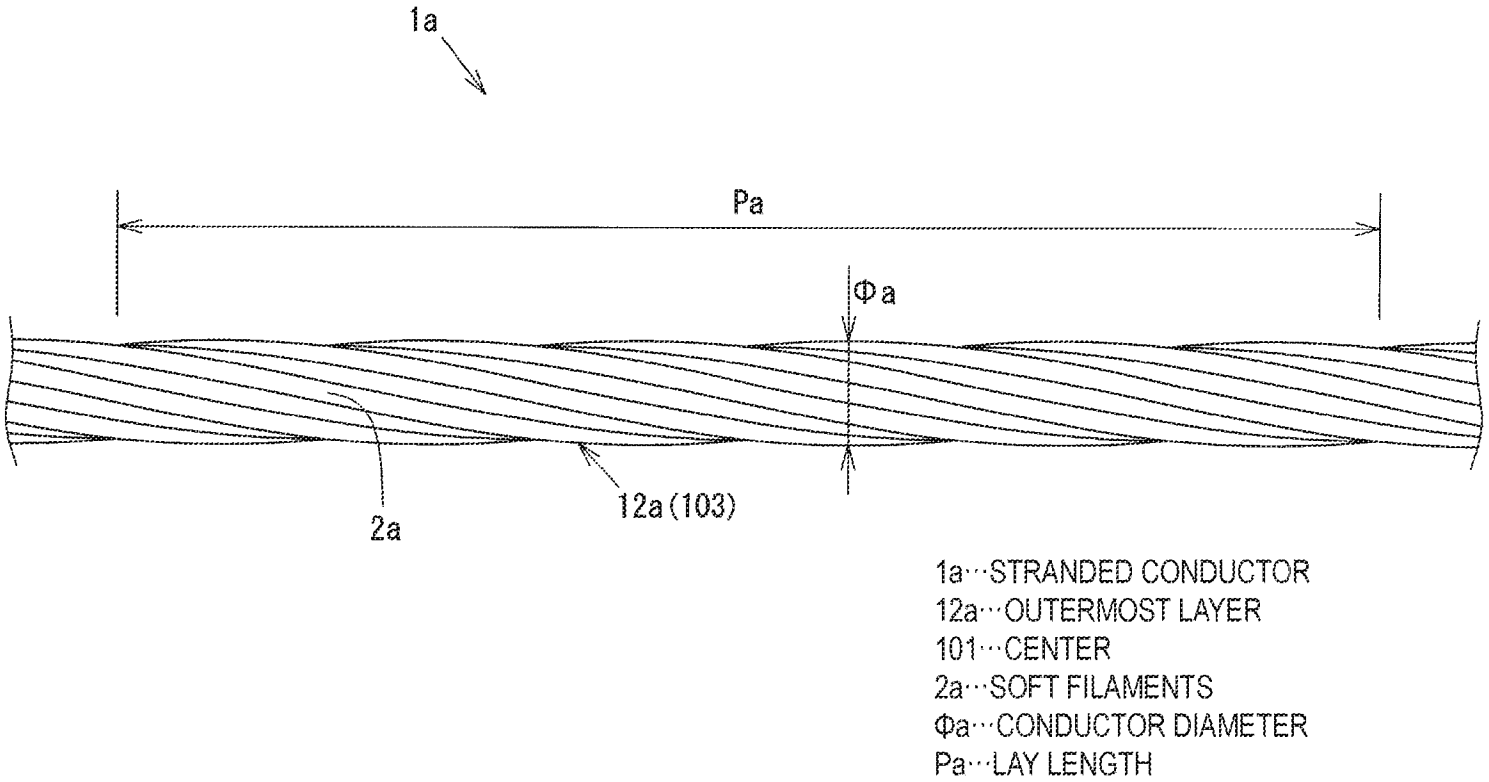
FIG. 2 is a front view of the stranded conductor according to the first embodiment.
Figure 3:
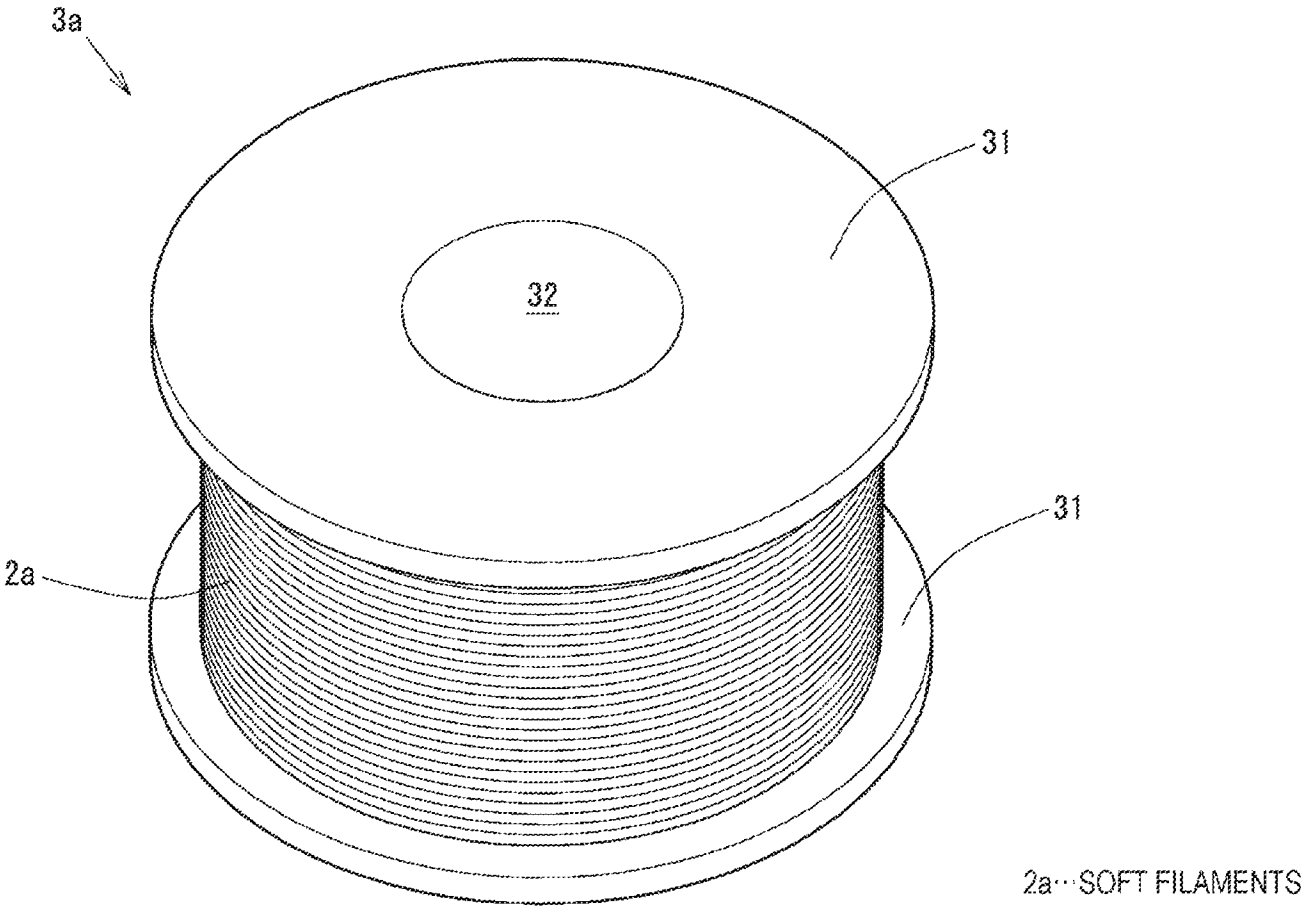
FIG. 3 is a perspective view of a bobbin.
Figure 4:
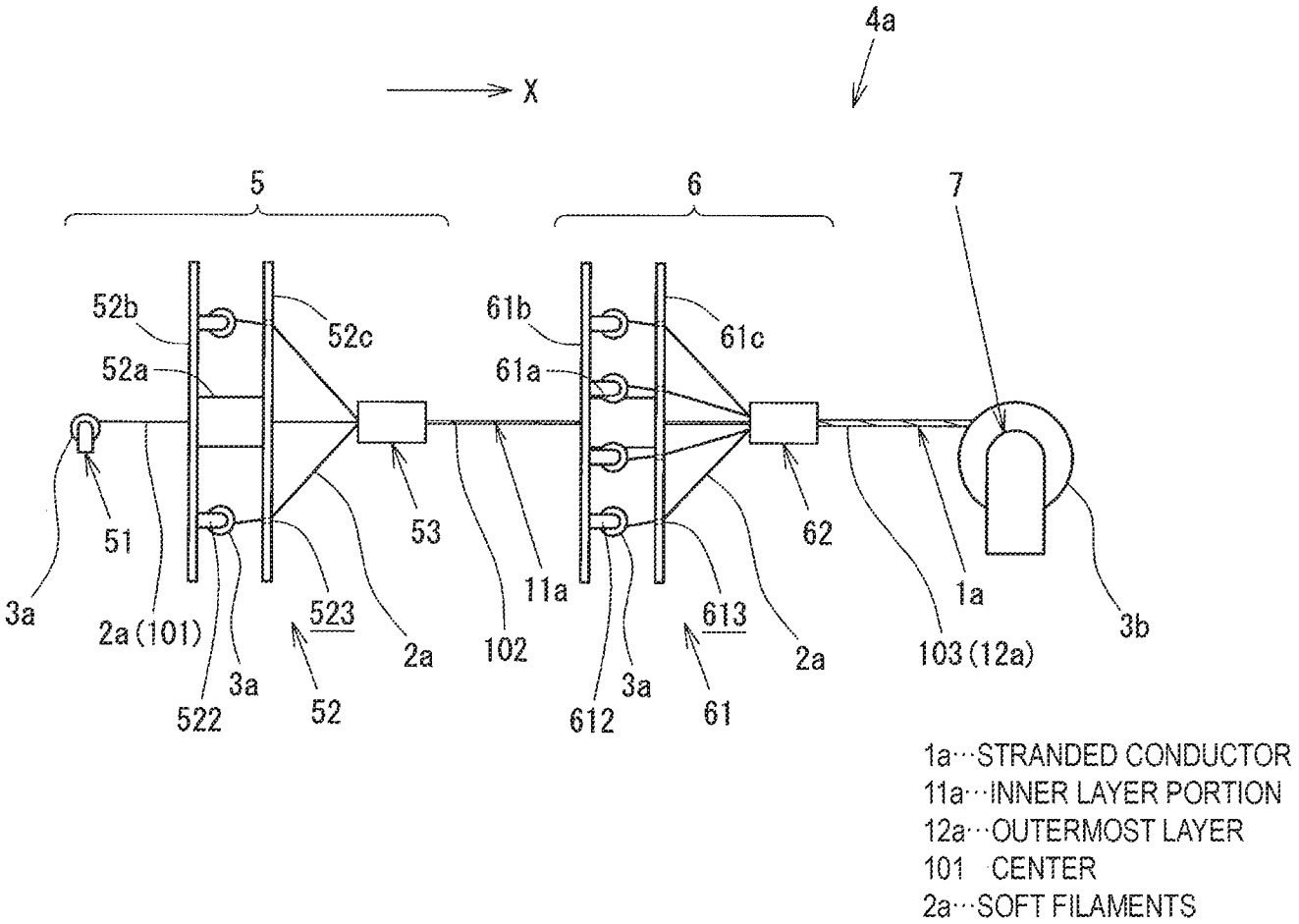
FIG. 4 is a schematic diagram of a stranding machine according to the first embodiment.
Figure 5:
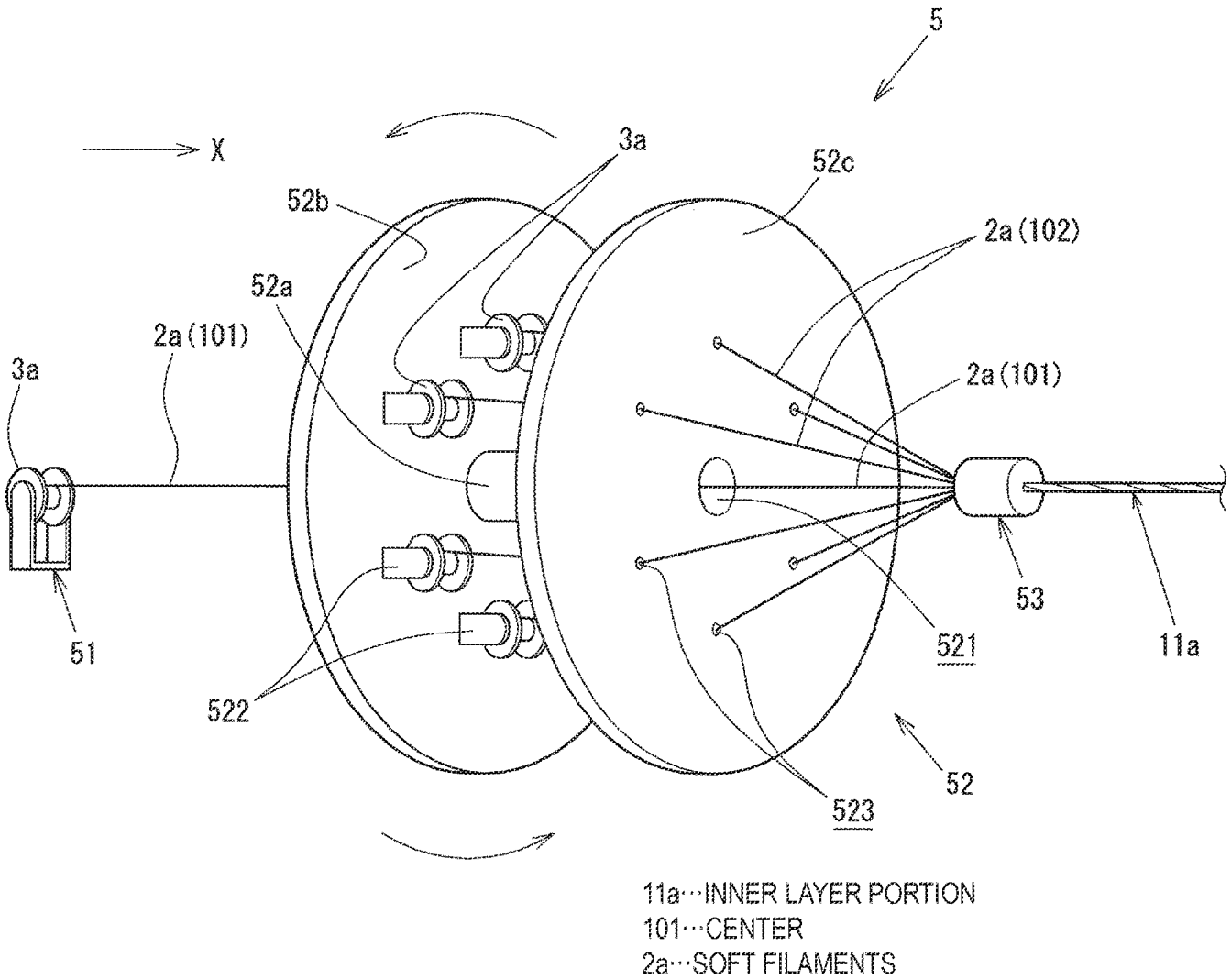
FIG. 5 is an enlarged perspective view of a second layer stranding unit according to the first embodiment.
Figure 6:
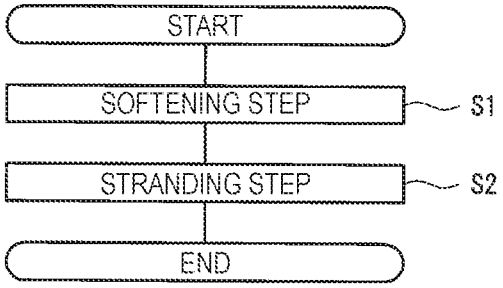
FIG. 6 is a flowchart illustrating a method for manufacturing the stranded conductor according to the first embodiment.

FIG. 1 is a perspective view of a stranded conductor 1*a*, according to the first embodiment. FIG. 2 is a front view of the stranded conductor 1*a* according to the first embodiment. FIG. 3 is a perspective view of a bobbin 3*a*, with a soft filament 2*a* wound thereon. FIG. 4 is a schematic diagram of a stranding machine 4*a*, according to the first embodiment. FIG. 5 is an enlarged perspective view of a second layer stranding unit 5, according to the first embodiment. FIG. 6 is a flowchart illustrating a method for manufacturing the stranded conductor 1*a* according to the first embodiment.

FIG. 1 is a perspective view of the stranded conductor 1*a*. To ensure that the 3-layer structure of the stranded conductor 1*a* can be easily understood, the lengths of the soft filaments 2*a* are illustrated, at one end of the stranded conductor 1*a*, in such a manner that the length decreases gradually, from a center 101 toward a third layer 103.

FIG. 4 is a schematic diagram of the stranding machine 4*a*. FIG. 4 is simplified so that it can be easily understood that the number of second bobbin attachment portions 522 and the number of third bobbin attachment portions 612 are different from each other. Bobbins 3*a* can be attached to the second bobbin attachment portions 522 and the third bobbin attachment portions 612.

The stranded conductor 1*a* according to the first embodiment is formed of nineteen soft filaments 2*a*, which are disposed concentrically and stranded together in the same direction around the central axis of the stranded conductor 1*a*, as illustrated in FIG. 1. The soft filaments 2*a* are softened filaments made of a pure aluminum-based material having a composition corresponding to that of JIS H4000 1070, and each have a diameter of 0.32 mm.

The stranded conductor 1*a* is a 3-layer structure with the center 101, described below, serving as a first layer. The stranded conductor 1*a* is formed of an inner layer portion 11*a*, which is formed of radially inner two layers, and an outermost layer 12*a*, which is located outside of the inner layer portion 11*a*.

Accordingly, a conductor diameter (pa, which is the diameter of the stranded conductor 1*a*, is 1.6 mm (see FIG. 2). The total cross-sectional area of the soft filaments 2*a*, as stranded together, is approximately 1.5 $mm^2$ (1.5 sq).

Specifically, the stranded conductor 1*a* is formed of the center 101 (corresponding to the first layer), a second layer 102, and a third layer 103. The center 101 is formed of a single soft filament 2*a*. The second layer 102 is formed of six soft filaments 2*a* disposed outside of the center 101. The third layer 103 is formed of twelve soft filaments 2*a* disposed outside of the second layer 102. The center 101 and the second layer 102 form the inner layer portion 11*a*, and the third layer 103 forms the outermost layer 12*a*.

As illustrated in FIG. 2, the stranded conductor 1*a* is configured such that a lay length Pa is 19.4 mm, which is approximately 12.1 times the conductor diameter φa. The lay length Pa is a lay length with which the soft filaments 2*a* are stranded. More specifically, the stranded conductor 1*a* is configured such that the lay length Pa for the second layer 102 and the lay length Pa for the third layer 103 are both 19.4 mm.

The lay length for the second layer 102 may not necessarily be the same as the lay length Pa for the third layer 103. It is possible that the lay length Pa for the second layer 102 may be different from the lay length Pa for the third layer 103.

The stranded conductor 1*a* may not necessarily be configured such that the lay length Pa is approximately 12.1 times the conductor diameter (pa. It is sufficient that the lay length Pa be from 8.6 times to 22.0 times the conductor diameter φa and more preferably be from 12.1 times to 20.7 times the conductor diameter φa.

The stranded conductor 1*a*, configured as described above, can be manufactured by using bobbins 3*a*, a stranding machine 4*a*, and a bobbin 3*b*. The bobbins 3*a* are each provided with a soft filament 2*a* wound thereon. The stranding machine 4*a* is used to strand together the soft filaments 2*a*. The bobbin 3*b* is used to coil the stranded conductor 1*a* therearound. The configurations of the bobbins 3*a* and 3*b* and the stranding machine 4*a* will be described below.

First, as illustrated in FIG. 3, the bobbin 3*a* is integrally formed by an axial core (not illustrated) and flanges 31 and 31. The soft filament 2*a* can be wound on the axial core. The flanges 31 and 31 are disposed at the respective ends of the axial core and have an annular shape.

The axial core is formed in a cylindrical shape and has a through hole 32, which extends through the axial core in an axial direction.

The inner circumferences of the flanges 31 and 31 are secured to the outer circumference of the axial core at the respective ends.

The bobbin 3*b* has the same configuration as the bobbin 3*a* and is thus not described.

Next, as illustrated in FIG. 4, the stranding machine 4*a* is formed by a second layer stranding unit 5, a third layer stranding unit 6, and a conductor coiling unit 7, which are disposed in this order. The second layer stranding unit 5 is used to strand the second layer 102. The third layer stranding unit 6 is used to strand the third layer 103. The conductor coiling unit 7 is used to coil the stranded conductor 1*a*.

The direction in which the second layer stranding unit 5, the third layer stranding unit 6, and the conductor coiling unit 7 are disposed, that is, the direction from the left to the right in FIGS. 4 and 5 is designated as a travel direction X, in which the soft filaments 2*a* travel.

As illustrated in FIG. 5, the second layer stranding unit 5 is formed by a first bobbin attachment portion 51, a second layer stranding member 52, and a second layer collect chuck 53, which are disposed in this order in the travel direction X. A bobbin 3*a* on which a soft filament 2*a* that forms the center 101 is wound can be attached to the first bobbin attachment portion 51. Bobbins 3*a* on which soft filaments 2*a* that form the second layer 102 are wound can be attached to the second layer stranding member 52. The second layer collect chuck 53 is used to collect the second layer 102 to the center 101.

The first bobbin attachment portion 51 includes a rotatable shaft and a rotation controller (not illustrated). The rotatable shaft can be inserted into the through hole 32 of the bobbin 3*a*, and thereby the bobbin 3*a* can be rotatably attached to the first bobbin attachment portion 51. The rotation controller controls the rotational speed of the rotatable shaft.

The rotation controller of the first bobbin attachment portion 51 can control the rotation speed of the rotatable shaft, on which the bobbin 3*a* is attached, in accordance with the rotation speed of the bobbin 3*b*, which is caused to rotate by a rotation controller of the conductor coiling unit 7, which will be described later. Thus, a desired tension can be applied to the soft filament 2*a* while being unwound.

The second layer stranding member 52 is integrally formed by an axial core 52*a*, a first flange 52*b*, and a second flange 52*c*. The axial core 52*a* has a cylindrical shape and extends in the travel direction X. The first flange 52*b* has a disc shape and is located at one end of the axial core 52*a*, closer to the first bobbin attachment portion 51. The second flange 52*c* has a disc shape and is located at an end opposite to the first bobbin attachment portion 51. The second layer stranding member 52 includes a rotation mechanism, which is not illustrated.

The axial core 52*a* includes therein a through hole 521, which extends through the axial core 52*a* along the travel direction X. The axial core 52*a* supports the first flange 52*b* and the second flange 52*c* while spacing them apart by a predetermined distance.

The first flange 52*b* is formed in a disc shape and has a hole at the center. The hole has a diameter similar to the outside diameter of the axial core 52*a*. The inner circumference of the first flange 52*b* is secured to the outer circumference of the axial core 52*a* at an end thereof. The first flange 52*b* includes six second bobbin attachment portions 522, which have the same configuration as the first bobbin attachment portion 51.

The six second bobbin attachment portions 522 are disposed to be evenly spaced on a concentric circle and are disposed to form a substantially regular hexagonal shape, when viewed in the travel direction X, on one of the surfaces of the first flange 52*b*, which is the surface closer to the second flange 52*c*.

Similar to the first flange 52*b*, the second flange 52*c* is formed in a disc shape and has a hole at the center. The hole has a diameter similar to the outside diameter of the axial core 52*a*. The second flange 52*c* is secured to the outer circumference of the axial core 52*a* at an end thereof. The second flange 52*c* includes six insertion holes 523 formed therein. The soft filaments 2*a*, when unwound from the bobbins 3*a* attached on the second bobbin attachment portions 522, can be inserted into the insertion holes 523.

The six insertion holes 523 are each formed in a circular shape slightly larger than the diameter of the soft filament 2*a*, and are disposed to be evenly spaced on a concentric circle, in other words, disposed to form a substantially regular hexagonal shape, when viewed in the travel direction X, at positions where the insertion holes 523 face the second bobbin attachment portions 522.

As described above, the number of the second bobbin attachment portions 522 is the same as the number of bobbins 3*a* to be attached to the second layer stranding unit 52, and the number of the insertion holes 523 is the same as the number of soft filaments 2*a* that form the second layer 102. That is, the numbers of the second bobbin attachment portions 522, the insertion holes 523, the soft filaments 2*a* that form the second layer, and the bobbins 3*a* on which the soft filaments 2*a* are wound, are the same.

The rotation mechanism included in the second layer stranding member 52 is a mechanism for rotating the second layer stranding member 52 about the central axis of the cylindrical axial core 52*a*, which extends in the travel direction X (e.g., direction indicated by the arrow in FIG. 5). The axial core 52*a* is provided with the rotation mechanism.

The axial core 52*a* may be provided with the rotation mechanism, but this is not a limitation. Instead, the first flange 52*b* or the second flange 52*c* may be provided with the rotation mechanism as long as the second layer stranding member 52 can be caused to rotate.

The second layer collect chuck 53 is formed in a cylindrical shape and has an inside diameter similar to the outside diameter of the second layer 102, that is, to the diameter of the inner layer portion 11*a*. The second layer collect chuck 53 is used to collect six soft filaments 2*a*, which pass through the insertion holes 523, around the center 101, which passes through the through hole 521.

The third layer stranding unit 6 is formed by the third layer stranding member 61 and the third layer collect chuck 62. The third layer stranding member 61 and the third layer collect chuck 62 have the same configurations as the second layer stranding member 52 and the second layer collect chuck 53 of the second layer stranding unit 5, and are thus not illustrated and will be briefly described below.

The third layer stranding member 61 is integrally formed by an axial core 61*a*, a first flange 61*b*, and a second flange 61*c*. The third layer stranding member 61 includes a rotation mechanism, which is not illustrated.

The axial core 61*a* is formed in a cylindrical shape and has therein a through hole 611, which extends through the axial core 61*a* along the travel direction X.

The first flange 61*b* includes twelve third bobbin attachment portions 612, and the second flange 61*c* includes twelve insertion holes 613 formed therein.

The third bobbin attachment portions 612 and the insertion holes 613 are each disposed to be evenly spaced on a concentric circle, in other words, disposed to form a substantially regular dodecagonal shape, when viewed in the travel direction X, at positions where the third bobbin attachment portions 612 and the insertion holes 613 face each other.

The rotation mechanism included in the third layer stranding member 61 has the same configuration as the rotation mechanism included in the above-described second layer stranding member 52. The axial core 61*a* is provided with the rotation mechanism.

The axial core 61*a* may be provided with the rotation mechanism, but this is not a limitation, as with the rotation mechanism included in the second layer stranding member 52.

The third layer collect chuck 62 is formed in a cylindrical shape and has an inside diameter similar to the outside diameter of the third layer 103, that is, to the conductor diameter (pa. The third layer collect chuck 62 is used to collect twelve soft filaments 2*a*, which pass through the insertion holes 613, around the second layer 102, which passes through the through hole 611.

As with the first bobbin attachment portion 51, the conductor coiling unit 7 includes a rotatable shaft and a rotation controller (not illustrated). The rotatable shaft can be inserted into the through hole 32 of the bobbin 3*b*, and thereby the bobbin 3*b* can be rotatably attached to the conductor coiling unit 7. The rotation controller causes the rotatable shaft to rotate. That is, with rotation of the rotatable shaft caused by the rotation mechanism, the conductor coiling unit 7 can coil the stranded conductor 1*a* around the bobbin 3*b*, which is attached on the rotatable shaft.

In the descriptions below, for convenience, the rotations of the first bobbin attachment portion 51, the second bobbin attachment portions 522, the third bobbin attachment portions 612, and the conductor coiling unit 7 are referred to as rotation, and the rotations of the second layer stranding member 52 and the third layer stranding member 61 are referred to as revolution.

The stranding machine 4*a*, configured as described above, forms the inner layer portion 11*a* by stranding the second layer 102 outside of the center 101 by using the second layer stranding member 52 and the second layer collect chuck 53, and forms the stranded conductor 1*a* by stranding the third layer 103 on the outside of the inner layer portion 11*a* by using the third layer stranding member 61 and the third layer collect chuck 62. By controlling, for example, the rotational speed and the timing for starting rotation of the second layer stranding unit 5, the third layer stranding unit 6, and the conductor coiling unit 7, the stranding machine 4*a* can strand together the soft filaments 2*a* with a predetermined lay length Pa and can apply a predetermined tension to the soft filaments 2*a*.

A method for manufacturing the stranded conductor 1*a* by using the bobbins 3*a* and 3*b* and the stranding machine 4*a*, configured as described above, will be described below.

As illustrated in FIG. 6, the stranded conductor 1*a* is manufactured by performing a softening step (step S1) of forming softened soft filaments 2*a* and thereafter performing a stranding step (step S2) of stranding together nineteen soft filaments 2*a*.

In the softening step (step S1), unsoftened filaments that have yet to be softened, in a state in which the filaments are wound on the bobbins 3*a*, are exposed to an elevated temperature of approximately 350° C. for approximately five hours to be softened. Thus, soft filaments 2*a*, which are softened filaments, are formed.

The temperature and duration for the softening step are not limited to the aforementioned settings and may be appropriately set provided that soft filaments 2*a* having a desired softness can be formed. In the case that filaments having a desired softness or pre-softened filaments are used, the softening step may be omitted.

In the stranding step (step S2), six soft filaments 2*a* that form the second layer 102 and twelve soft filaments 2*a* that form the third layer 103 are positioned outside of the center 101, and the soft filaments 2*a* are stranded sequentially to manufacture the stranded conductor 1*a*.

Specifically, in the stranding step (step S2), first, bobbins 3*a* on which softened soft filaments 2*a* are wound are attached to the first bobbin attachment portion 51, the second bobbin attachment portions 522, and the third bobbin attachment portions 612.

The leading ends of the soft filaments 2*a*, as unwound from the bobbins 3*a* attached on the respective bobbin attachment portions, are passed through the predetermined portions and bundled together, and in this state, are secured to the bobbin 3*b* attached on the conductor coiling unit 7.

After securement of the soft filaments 2*a* to the bobbins 3*b* is completed, the first bobbin attachment portion 51, the second bobbin attachment portions 522, the third bobbin attachment portions 612, and the conductor coiling unit 7 are caused to rotate while causing the second layer stranding member 52 and the third layer stranding member 61 to revolve in the same direction.

During this, a tension of 2.0 N is applied to each of the soft filaments 2*a* to be stranded together, by controlling the rotation speeds of the first bobbin attachment portion 51, the second bobbin attachment portions 522, and the third bobbin attachment portions 612, in accordance with the rotation speed of the conductor coiling unit 7.

The tension to be applied to the soft filaments 2*a* may not necessarily be 2.0 N and may be appropriately set to a range from 1.5 N to 2.5 N.

Furthermore, the revolution speeds of the second layer stranding member 52 and the third layer stranding member 61 are controlled in accordance with the rotation speed of the conductor coiling unit 7, to strand together the soft filaments 2*a* with the lay length Pa of 19.4 mm, which is approximately 12.1 times the conductor diameter φa. In the present embodiment, the revolution speeds of the second layer stranding member 52 and the third layer stranding member 61 are the same, and thereby, the lay length for the second layer 102 and the third layer 103 are made to be 19.4 mm.

The stranding step (step S2), described above, is continued until a desired length of the stranded conductor 1*a* is reached.

As described above, the stranded conductor 1*a* is formed of a soft filament 2*a* made of an aluminum material, which is disposed along the center 101, and six soft filaments 2*a* and twelve soft filaments 2*a* that are sequentially disposed around and concentrically with the center 101. The soft filaments 2*a* are stranded together. The soft filaments 2*a* are softened filaments. The lay length Pa is approximately 12.1 times the conductor diameter φa, which corresponds to from 8.6 times to 22.0 times. As a result, the desired stranded conductor 1*a* is formed in which the occurrence of defects, such as strand unevenness of soft filaments 2*a* and outward protrusion of soft filaments 2*a*, is inhibited.

Specifically, in a case where the lay length Pa is smaller than 8.6 times the conductor diameter φa, the angle of the soft filaments 2*a* to be stranded together, with respect to the central axis of the stranded conductor 1*a*, is large, and thus strand unevenness may occur in the soft filaments 2*a*.

On the other hand, in a case where the lay length Pa is larger than 22.0 times the conductor diameter (pa, the twist length per pitch of the outermost layer 12*a* is long. Thus, the twisting load of the outermost layer 12*a* that acts on the inner layer portion 11*a* is dispersed, that is, the twisting load that acts on the inner layer portion 11*a* decreases. Also, the soft filaments 2*a* that form the outermost layer 12*a* are nearly parallel to the central axis of the stranded conductor 1*a*. As a result, the soft filaments 2*a* that form the inner layer portion 11*a* may protrude outward from between the soft filaments 2*a* that form the outermost layer 12*a*.

In contrast, by configuring the lay length Pa to be approximately 12.1 times the conductor diameter φa, which corresponds to from 8.6 times to 22.0 times, soft filaments 2*a* can be stranded together at a desired angle with respect to the central axis of the stranded conductor 1*a*, and also, the twisting load of the outermost layer 12*a* that acts on the inner layer portion 11*a* can be a desired twisting load. As a result, the occurrence of strand unevenness of the soft filaments 2*a* is inhibited, and outward protrusion of the soft filaments 2*a* that form the inner layer portion 11*a* from between the soft filaments 2*a* that form the outermost layer 12*a* is inhibited.

Consequently, the desired stranded conductor 1*a* is formed. Thus, for example, in the case that the outer periphery of the stranded conductor 1*a* is to be covered with an insulating covering, the insulating covering is prevented from becoming partially thinner, which may otherwise occur by outward protrusion of soft filaments 2*a*. Thus, desired insulating properties are achieved.

Since the lay length Pa of the stranded conductor 1*a* is from 12.1 times to 20.7 times the conductor diameter (pa, the desired stranded conductor 1*a* is formed in which the occurrence of defects, such as strand unevenness of soft filaments 2*a* and protrusion of soft filaments 2*a*, is reliably prevented.

Furthermore, in the stranding step, a tension of 2.0 N, which corresponds to from 1.5 N to 2.5 N, is applied to the soft filaments 2*a*. As a result, the stranded conductor 1*a*, stranded with a predetermined lay length Pa, is manufactured without slackening.

Specifically, in a case where a tension of less than 1.5 N is applied to the soft filaments 2*a* or no tension is applied to the soft filaments 2*a* to carry out stranding, slackening may occur in the soft filaments 2*a* to be stranded together or slackening may occur in the stranded conductor 1*a* formed by the stranding.

On the other hand, in a case where a tension of greater than 2.5 N is applied to the soft filaments 2*a* to carry out stranding, the soft filaments 2*a* to be stranded together may become elongated or broken.

In contrast, by applying a tension of 2.0 N, which corresponds to from 1.5 N to 2.5 N, to the soft filaments 2*a*, the occurrence of slackening in the soft filaments 2*a* to be stranded together or in the stranded conductor 1*a* obtained by the stranding is prevented, and also, elongation or breakage of the soft filaments 2*a* is prevented.

Thus, the soft filaments 2*a* can be stranded together without slackening with the lay length Pa of approximately 12.1 times the conductor diameter pa, which corresponds to from 8.6 times to 22.0 times. As a result, the desired stranded conductor 1*a* is manufactured in which the occurrence of defects, such as strand unevenness of soft filaments 2*a* and outward protrusion of soft filaments 2*a*, is prevented.

In the following, No. 1-1 strand test will be described. No. 1-1 strand test is a test for verifying the effects of the stranded conductor 1*a*, which produces effects such as described above.

No. 1-1 strand test is a test for evaluating a stranded conductor (designated as test specimen A) formed of nineteen soft filaments 2*a* stranded together. The nineteen soft filaments 2*a* are softened in advance.

First, as test specimens A formed in No. 1-1 strand test, the following were used: test specimen Aa, having a lay length Pa of 7.4 times the conductor diameter pa; test specimen Ab, 7.8 times; test specimen Ac, 8.6 times; test specimen Ad, 11.0 times; test specimen Ae, 12.1 times; test specimen Af, 20.7 times; test specimen Ag, 21.8 times; test specimen Ah, 22.0 times; test specimen Ai, 25.4 times; and test specimen Aj, 31.8 times.

Further, as test specimens Aa, described above, the following were used, for each of which the tension was applied to soft filaments 2*a*: test specimen Aa1, manufactured while applying a tension of 1.0 N; test specimen Aa2, manufactured while applying a tension of 1.5 N; test specimen Aa3, manufactured while applying a tension of 2.0 N; test specimen Aa4, manufactured while applying a tension of 2.5 N; and test specimen Aa5, manufactured while applying a tension of 3.0 N.

Further, as test specimens Ab to Aj, the following were used: test specimens Ab1 to Ab5; test specimens Ac1 to Ac5; test specimens Ad1 to Ad5; test specimens Ae1 to Ae5; test specimens Af1 to Af5; test specimens Ag1 to Ag5; test specimens Ah1 to Ah5; test specimens Ai1 to Ai5; and test specimens Aj1 to Aj5. For these test specimens, the tension applied to the soft filaments 2*a* was varied in the same manner as that for test specimens Aa.

In No. 1-1 strand test, for each type of specimen described above, ten specimens were manufactured, and the presence or absence of defects, such as strand unevenness of soft filaments 2*a* and protrusion of soft filaments 2*a*, was evaluated from the appearances of five randomly selected specimens. The results of the evaluation are shown in Table 1-1 below.

TABLE 1-1

| Tension (N) | Lay length (coefficient) | | | | | | | | | |
|---|---|---|---|---|---|---|---|---|---|---|
| Filaments | 7.4 | 7.8 | 8.6 | 11.0 | 12.1 | 20.7 | 21.8 | 22.0 | 25.4 | 31.8 |
| 1.0 | D<br>Aa1 | D<br>Ab1 | C<br>Ac1 | C<br>Ad1 | B<br>Ae1 | B<br>Af1 | C<br>Ag1 | C<br>Ah1 | D<br>Ai1 | D<br>Aj1 |
| 1.5 | D<br>Aa2 | D<br>Ab2 | B<br>Ac2 | B<br>Ad2 | A<br>Ae2 | A<br>Af2 | B<br>Ag2 | B<br>Ah2 | D<br>Ai2 | D<br>Aj2 |
| 2.0 | D<br>Aa3 | C<br>Ab3 | B<br>Ac3 | B<br>Ad3 | A<br>Ae3 | A<br>Af3 | B<br>Ag3 | B<br>Ah3 | D<br>Ai3 | D<br>Aj3 |
| 2.5 | D<br>Aa4 | C<br>Ab4 | B<br>Ac4 | B<br>Ad4 | A<br>Ae4 | A<br>Af4 | B<br>Ag4 | B<br>Ah4 | C<br>Ai4 | D<br>Aj4 |
| 3.0 | D<br>Aa5 | D<br>Ab5 | C<br>Ac5 | C<br>Ad5 | B<br>Ae5 | B<br>Af5 | C<br>Ag5 | C<br>Ah5 | D<br>Ai5 | D<br>Aj5 |

Table 1-1 above shows the results of the evaluation of the test specimens. The parameters are the coefficient to be multiplied with the conductor diameter φa to calculate the lay length Pa and the tension applied to the soft filaments 2*a*.

In Table 1-1, the symbol "A" indicates that the stranding was accomplished with a desired lay length Pa over all sections of the test specimen, and that no defects, such as strand unevenness or outward protrusion of soft filaments 2*a* or elongation or breakage of soft filaments 2*a*, occurred, and the symbol "B" indicates that, although, in some sections, the lay length was different from a desired lay length Pa to a tolerable degree, none of the defects described above occurred.

The symbol "C" indicates that the lay length in some sections was slightly different from a desired lay length Pa and that a defect, described above, occurred in two or less test specimens of the five, and the symbol "D" indicates that the lay length was different from a desired lay length Pa over all sections and that a defect, described above, occurred in three or more test specimens of the five. That is, it is indicated that stranded conductors having an evaluation result of "B" were manufactured with no problems for use as end products, and stranded conductors having an evaluation result of "C" or "D" had problems for use as end products.

The results are as follows. Table 1-1 above shows that the occurrence of the defects described above was inhibited in test specimens Ac2 to Ah2, Ac3 to Ah3, and Ac4 to Ah4, and that the stranding was accomplished with a desired lay length Pa over all sections of test specimen, in test specimens Ae2 to Ae4 and Af2 to Af4.

On the other hand, strand unevenness of soft filaments 2*a* occurred in test specimens Aa1 to Aa5 and Ab1 to Ab5, and outward protrusion of soft filaments 2*a* occurred in test specimens Ai1 to Ai5 and Aj1 to Aj5.

Further, strand unevenness of soft filaments 2*a* occurred in some of test specimens Aa1 to Aj1 and elongation or breakage of soft filaments 2*a* occurred in some of test specimens Aa5 to Aj5.

From the results described above, it was observed that, in the case that the lay length Pa is less than or equal to 7.8 times the conductor diameter pa, strand unevenness of the soft filaments 2*a* to be stranded together may occur and that, in the case that the lay length Pa is greater than or equal to 25.4 times the conductor diameter pa, outward protrusion of the soft filaments 2*a* that form the inner layer portion 11*a* may occur.

Further, it was observed that, in the case that the tension applied to the soft filaments 2*a* is less than or equal to 1.0 N or no tension is applied, strand unevenness of the soft filaments 2*a* to be stranded together may occur and that, in the case that the tension applied to the soft filaments 2*a* is greater than or equal to 3.0 N, elongation or breakage of the soft filaments 2*a* may occur.

From the above, the following was observed. For the stranded conductor 1*a*, formed of nineteen soft filaments 2*a*, softened in advance, stranded together, the stranding can be performed while applying a tension from 1.5 N to 2.5 N to the soft filaments 2*a*, to thereby achieve a lay length Pa from 8.6 times to 22.0 times the conductor diameter pa. This inhibits the occurrence of the defects described above, and, in the case that the lay length Pa is from 12.1 times to 20.7 times the conductor diameter pa, prevents more reliably the occurrence of the defects described above.

In the description above, the stranded conductor 1*a* is formed of soft filaments 2*a* formed from a pure aluminum-based material having a composition corresponding to that of JIS H4000 1070. Instead, the stranded conductor may be formed of soft filaments obtained by softening filaments made of a high-strength aluminum alloy material containing, for example, magnesium and silicon added thereto and having an improved tensile strength compared with that of filaments made of a pure aluminum-based material having a composition corresponding to that of JIS H4000 1070. In such a case, by stranding together the soft filaments while applying thereto a tension from 1.0 N to 4.5 N, a desired stranded conductor, stranded with a predetermined lay length Pa without slackening, is manufactured. In the examples of this specification, the "filaments made of a high-strength aluminum alloy material" correspond to the wire rod described in "WO 2014/155817" and the composition is the same as that of "Invention Example 39" in Table 1. Specifically, Mg=0.50 mass %, Si=0.50 mass %, Fe=0.20 mass %, Ti=0.010 mass %, B=0.003 mass %, Ni=0.10 mass %, and the balance is aluminum and unavoidable impurities. In the present invention, the "filaments made of a high-strength aluminum alloy material" is not limited to the example described above, and may be a wire rod within the range disclosed in "WO 2014/155817" or a wire rod having a similar composition.

No. 1-2 strand test will be described below. No. 1-2 strand test is a test for verifying the effects of stranded conductors manufactured from soft filaments formed from an aluminum alloy material having a higher strength than a pure aluminum-based material having a composition corresponding to that of JIS H4000 1070.

First, as test specimens A formed in No. 1-2 strand test, test specimens Aa to Aj, each of which had the same lay length Pa as that in the above described No. 1-1 strand test, were used.

Further, as test specimens Aa, described above, the following were used, for each of which the tension was applied to soft filaments formed from a high-strength aluminum alloy material: test specimens Aa1 to Aa5, each manufactured while applying a similar tension to that of No. 1-1 strand test; test specimen Aa6, manufactured while applying a tension of 0.5 N; test specimen Aa7, manufactured while applying a tension of 3.5 N; test specimen Aa8, manufactured while applying a tension of 4.0 N; test specimen Aa9, manufactured while applying a tension of 4.5 N; and test specimen Aa10, manufactured while applying a tension of 5.0 N.

Further, as test specimens Ab to Aj, the following were used: test specimens Ab1 to Ab10; test specimens Ac1 to Ac10; test specimens Ad1 to Ad10; test specimens Ae1 to Ae10; test specimens Af1 to Af10; test specimens Ag1 to Ag10; test specimens Ah1 to Ah10; test specimens Ai1 to Ai10; and test specimens Aj1 to Aj10. For these test specimens, the tension applied to the soft filaments was varied in the same manner as that for test specimens Aa.

No. 1-2 strand test was conducted by using the test specimens described above. The results of the evaluation are shown in Table 1-2 below.

TABLE 1-2

| Tension (N) | Lay length (coefficient) | | | | | | | | | |
|---|---|---|---|---|---|---|---|---|---|---|
| Filaments | 7.4 | 7.8 | 8.6 | 11.0 | 12.1 | 20.7 | 21.8 | 22.0 | 25.4 | 31.8 |
| 0.5 | D<br>Aa6 | D<br>Ab6 | C<br>Ac6 | C<br>Ad6 | B<br>Ae6 | B<br>Af6 | C<br>Ag6 | C<br>Ah6 | D<br>Ai6 | D<br>Aj6 |

TABLE 1-2-continued

| Tension (N) | Lay length (coefficient) | | | | | | | | | |
|---|---|---|---|---|---|---|---|---|---|---|
| Filaments | 7.4 | 7.8 | 8.6 | 11.0 | 12.1 | 20.7 | 21.8 | 22.0 | 25.4 | 31.8 |
| 1.0 | D | D | B | B | A | A | B | B | D | D |
| | Aa1 | Ab1 | Ac1 | Ad1 | Ae1 | Af1 | Ag1 | Ah1 | Ai1 | Aj1 |
| 1.5 | D | D | B | B | A | A | B | B | D | D |
| | Aa2 | Ab2 | Ac2 | Ad2 | Ae2 | Af2 | Ag2 | Ah2 | Ai2 | Aj2 |
| 2.0 | D | D | B | B | A | A | B | B | C | D |
| | Aa3 | Ab3 | Ac3 | Ad3 | Ae3 | Af3 | Ag3 | Ah3 | Ai3 | Aj3 |
| 2.5 | D | D | B | B | A | A | B | B | C | D |
| | Aa4 | Ab4 | Ac4 | Ad4 | Ae4 | Af4 | Ag4 | Ah4 | Ai4 | Aj4 |
| 3.0 | D | C | B | B | A | A | B | B | C | D |
| | Aa5 | Ab5 | Ac5 | Ad5 | Ae5 | Af5 | Ag5 | Ah5 | Ai5 | Aj5 |
| 3.5 | D | C | B | B | A | A | B | B | C | D |
| | Aa7 | Ab7 | Ac7 | Ad7 | Ae7 | Af7 | Ag7 | Ah7 | Ai7 | Aj7 |
| 4.0 | D | C | B | B | A | A | B | B | C | D |
| | Aa8 | Ab8 | Ac8 | Ad8 | Ae8 | Af8 | Ag8 | Ah8 | Ai8 | Aj8 |
| 4.5 | D | C | B | B | A | A | B | B | D | D |
| | Aa9 | Ab9 | Ac9 | Ad9 | Ae9 | Af9 | Ag9 | Ah9 | Ai9 | Aj9 |
| 5.0 | D | D | C | C | B | B | C | C | D | D |
| | Aa10 | Ab10 | Ac10 | Ad10 | Ae10 | Af10 | Ag10 | Ah10 | Ai10 | Aj10 |

The results are as follows. Table 1-2 above shows that the occurrence of defects, such as strand unevenness of soft filaments, outward protrusion of soft filaments, and elongation or breakage of soft filaments, was inhibited in test specimens Ac1 to Ah1, Ac2 to Ah2, Ac3 to Ah3, Ac4 to Ah4, Ac5 to Ah5, Ac7 to Ah7, Ac8 to Ah8, and Ac9 to Ah9, and further that the stranding was accomplished with a desired lay length Pa over all sections of test specimen, in test specimens Ae1 to Ae5, Ae7 to Ae9, Af1 to Af5, and Af7 to Af9.

On the other hand, strand unevenness of soft filaments occurred in test specimens Aa1 to Aa10 and Ab1 to Ab10, and outward protrusion of soft filaments occurred in test specimens Ai1 to Ai10 and Aj1 to Aj10.

Further, strand unevenness of soft filaments occurred in some of test specimens Aa6 to Aj6 and elongation or breakage of soft filaments occurred in some of test specimens Aa10 to Aj10.

From the above, the following was observed. For the stranded conductor formed of soft filaments formed from a high-strength aluminum alloy material, the stranding can be performed while applying a tension from 1.0 N to 4.5 N to the soft filaments, to thereby achieve a lay length Pa from 8.6 times to 22.0 times the conductor diameter (pa. This inhibits the occurrence of the defects described above, and, in the case that the lay length Pa is from 12.1 times to 20.7 times the conductor diameter (pa, prevents more reliably the occurrence of the defects described above.

In the description above, the stranded conductor 1*a* is formed of nineteen soft filaments 2*a* stranded together, which are softened in advance. Instead, a stranded conductor 1*b* may be formed by stranding together nineteen hard filaments 2*b*. The hard filaments 2*b* are unsoftened filaments that are unsoftened and harder than the soft filaments 2*a*. While not softened in advance, the hard filaments 2*b* are formed from a pure aluminum-based material having a composition corresponding to that of JIS H4000 1070, as with the soft filaments 2*a*.

That is, the stranded conductor 1*b* has a configuration similar to that of the stranded conductor 1*a* in the first embodiment described above, and is thus not illustrated and will be briefly described below.

The stranded conductor 1*b* is formed of hard filaments 2*b* stranded together such that a lay length Pb is 19.4 mm, which is approximately 12.1 times a conductor diameter φb. The hard filaments 2*b* are harder than the soft filaments 2*a*.

The stranded conductor 1*b* may not necessarily be configured such that the lay length Pb is approximately 12.1 times the conductor diameter φb. It is sufficient that the lay length Pb be from 6.4 times to 16.9 times the conductor diameter φb and more preferably be from 9.6 times to 15.4 times the conductor diameter φb.

A method for manufacturing the stranded conductor 1*b*, configured as described above, will be described with reference to FIG. 7.

Figure 7:
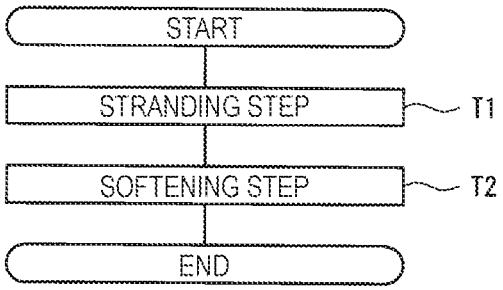
FIG. 7 is a flowchart illustrating a method for manufacturing a stranded conductor according to another embodiment.

FIG. 7 is a flowchart illustrating a method for manufacturing the stranded conductor 1*b*.

As illustrated in FIG. 7, the stranded conductor 1*b* is manufactured by performing a stranding step (step T1) of stranding together the hard filaments 2*b*, which are unsoftened, and thereafter performing a softening step (step T2) of softening the stranded conductor 1*b* obtained by the stranding.

The stranding step (step T1) and the softening step (step T2) in the method for manufacturing the stranded conductor 1*b* are steps similar to the softening step (step S1) and the stranding step (step S2) in the above-described method for manufacturing the stranded conductor 1*a*, and thus will be briefly described below.

The stranding step (step T1) is performed as follows. Bobbins 3*a* on which unsoftened, hard filaments 2*b* are wound are attached to the first bobbin attachment portion 51, the second bobbin attachment portions 522, and the third bobbin attachment portions 612 of the stranding machine 4*a* described above. Thereafter, the first bobbin attachment portion 51, the second bobbin attachment portions 522, the third bobbin attachment portions 612, and the conductor coiling unit 7 are caused to rotate while causing the second layer stranding member 52 and the third layer stranding member 61 to revolve in the same direction.

During this, a tension of 6.0 N is applied to each of the hard filaments 2*b* to be stranded together to accomplish stranding of the hard filaments 2*b* with a lay length Pb of 19.4 mm, which is approximately 12.1 times the conductor diameter φb.

The tension to be applied to the hard filaments 2*b* may not necessarily be 6.0 N and may be appropriately set to a range from 5.0 N to 7.0 N. The stranding step (step T1), described above, is continued until a desired length of the stranded conductor 1*b* is reached.

Next, in the softening step (step T2), the stranded conductor 1*b* obtained by stranding together the hard filaments 2*b* is exposed to an elevated temperature of 350° C. for five hours while remaining wound on the bobbin 3*b* on which the stranded conductor 1*b* is wound. Thus, the stranded conductor 1*b* is softened.

By manufacturing the stranded conductor 1*b* as described above, the stranded conductor 1*b*, which is comparable to the stranded conductor 1*a* described above, can be formed even when the filaments for stranding are the hard filaments 2*b*, which are harder than the soft filaments 2*a*.

As described above, the stranded conductor 1*b* is formed of unsoftened, hard filaments 2*b*. The lay length Pb is approximately 12.1 times the conductor diameter φb, which corresponds to from 6.4 times to 16.9 times. As a result, the desired stranded conductor 1*b* is formed in which the occurrence of defects, such as strand unevenness of hard filaments 2*b* and outward protrusion of hard filaments 2*b*, is inhibited.

Since the lay length Pb of the stranded conductor 1*b* is from 9.6 times to 15.4 times the conductor diameter φb, the desired stranded conductor 1*b* is formed in which the occurrence of defects, such as strand unevenness of hard filaments 2*b* and outward protrusion of hard filaments 2*b*, is reliably prevented.

Further, in the stranding step, a tension of 6.0 N, which corresponds to from 5.0 N to 7.0 N, is applied to the hard filaments 2*b*, and thus, the hard filaments 2*b*, which are harder than soft filaments 2*a*, can be stranded together with a predetermined lay length Pb without slackening. As a result, the desired stranded conductor 1*b* is manufactured in which the occurrence of defects, such as strand unevenness of hard filaments 2*b* and outward protrusion of hard filaments 2*b*, is prevented.

Moreover, by performing the softening step after the stranding step, rather than performing the softening step in advance to form nineteen soft filaments 2*a*, in other words, by performing the softening step on the stranded conductor 1*b* obtained by the stranding, the treatment length can be shortened. As a result, for example, the softening facility can be reduced in size, for example.

In the following, No. 2-1 strand test will be described. No. 2-1 strand test is a test for verifying the effects of the stranded conductor 1*b*, which produces effects such as described above.

No. 2-1 strand test is a test for evaluating a stranded conductor (designated as test specimen B) formed of nineteen unsoftened, hard filaments 2*b* stranded together.

First, as test specimens B formed in No. 2-1 strand test, the following were used: test specimen Ba, having a lay length Pb of 5.1 times the conductor diameter φb; test specimen Bb, 5.9 times; test specimen Bc, 6.4 times; test specimen Bd, 8.6 times; test specimen Be, 9.6 times; test specimen Bf, 15.4 times; test specimen Bg, 16.9 times; test specimen Bh, 17.8 times; and test specimen Bi, 18.7 times.

Further, as test specimens Ba, described above, the following were used, for each of which the tension was applied to the hard filaments 2*b*: test specimen Ba1, formed while applying a tension of 4.5 N; test specimen Ba2, manufactured while applying a tension of 5.0 N; test specimen Ba3, manufactured while applying a tension of 5.5 N; test specimen Ba4, manufactured while applying a tension of 6.0 N; test specimen Ba5, manufactured while applying a tension of 6.5 N; test specimen Ba6, manufactured while applying a tension of 7.0 N; and test specimen Ba7, manufactured while applying a tension of 7.5 N.

Further, as test specimens Bb to Bi, the following were used: test specimens Bb1 to Bb7; test specimens Bc1 to Bc7; test specimens Bd1 to Bd7; test specimens Be1 to Be7; test specimens Bf1 to Bf7; test specimens Bg1 to Bg7; test specimens Bh1 to Bh7; and test specimens Bi1 to Bi7. For these test specimens, the tension applied to the hard filaments 2*b* was varied in the same manner as that for test specimens Ba.

In No. 2-1 strand test, for each type of specimen described above, ten specimens were manufactured as with No. 1-1 strand test, described above, and the presence or absence of defects was evaluated from the appearances of five randomly selected specimens. The results of the evaluation are shown in Table 2-1 below.

TABLE 2-1

| Tension (N) | Lay length (coefficient) | | | | | | | | |
|---|---|---|---|---|---|---|---|---|---|
| Filaments | 5.1 | 5.9 | 6.4 | 8.6 | 9.6 | 15.4 | 16.9 | 17.8 | 18.7 |
| 4.5 | D | D | C | C | B | B | C | D | D |
| | Ba1 | Bb1 | Bc1 | Bd1 | Be1 | Bf1 | Bg1 | Bh1 | Bi1 |
| 5.0 | D | D | B | B | A | A | B | D | D |
| | Ba2 | Bb2 | Bc2 | Bd2 | Be2 | Bf2 | Bg2 | Bh2 | Bi2 |
| 5.5 | D | D | B | B | A | A | B | D | D |
| | Ba3 | Bb3 | Bc3 | Bd3 | Be3 | Bf3 | Bg3 | Bh3 | Bi3 |
| 6.0 | D | D | B | B | A | A | B | D | D |
| | Ba4 | Bb4 | Bc4 | Bd4 | Be4 | Bf4 | Bg4 | Bh4 | Bi4 |
| 6.5 | D | C | B | B | A | A | B | D | D |
| | Ba5 | Bb5 | Bc5 | Bd5 | Be5 | Bf5 | Bg5 | Bh5 | Bi5 |
| 7.0 | D | C | B | B | A | A | B | C | D |
| | Ba6 | Bb6 | Bc6 | Bd6 | Be6 | Bf6 | Bg6 | Bh6 | Bi6 |
| 7.5 | D | D | C | C | B | B | C | D | D |
| | Ba7 | Bb7 | Bc7 | Bd7 | Be7 | Bf7 | Bg7 | Bh7 | Bi7 |

The results are as follows. Table 2-1 above shows that the occurrence of defects, such as strand unevenness of hard filaments 2*b*, outward protrusion of hard filaments 2*b*, and elongation or breakage of hard filaments 2*b*, was inhibited in test specimens Bc2 to Bg2, Bc3 to Bg3, Bc4 to Bg4, Bc5 to Bg5, and Bc6 to Bg6, and further that the stranding was accomplished with a desired lay length Pb over all sections of test specimen, in test specimens Be2 to Be6, and Bf2 to Bf6.

On the other hand, strand unevenness of hard filaments 2*b* occurred in test specimens Ba1 to Ba7 and Bb1 to Bb7, and outward protrusion of hard filaments 2*b* occurred in test specimens Bh1 to Bh7 and Bi1 to Bi7.

Further, strand unevenness of hard filaments 2*b* occurred in some of test specimens Ba1 to Bi1 and elongation or breakage of hard filaments 2*b* occurred in some of test specimens Ba1 to Bi7.

From the above, the following was observed. For the stranded conductor 1*b*, formed of nineteen unsoftened, hard filaments 2*b* stranded together, the stranding can be performed while applying a tension from 5.0 N to 7.0 N to the hard filaments 2*b*, to thereby achieve a lay length Pb from 6.4 times to 16.9 times the conductor diameter φb. This inhibits the occurrence of the defects described above, and, in the case that the lay length Pb is from 9.6 times to 15.4 times the conductor diameter φb, prevents more reliably the occurrence of the defects described above.

In the description above, the stranded conductor 1*b* is formed of hard filaments 2*b* formed from a pure aluminum-based material having a composition corresponding to that of JIS H4000 1070. Instead, the stranded conductor may be formed of hard filaments formed from a high-strength aluminum alloy material containing magnesium and silicon added thereto and having an improved tensile strength compared with that of a pure aluminum-based material having a composition corresponding to that of JIS H4000 1070.

In such a case, by stranding together the hard filaments while applying thereto a tension from 5.0 N to 7.0 N, a desired stranded conductor, stranded with a predetermined lay length Pb without slackening, is manufactured. That is, the conditions for manufacturing the stranded conductor obtained by stranding together hard filaments formed from a high-strength aluminum alloy material are the same as the conditions for manufacturing the stranded conductor 1*b*, which is obtained by stranding together the hard filaments 2*b* formed from a pure aluminum-based material having a composition corresponding to that of JIS H4000 1070, described above.

No. 2-2 strand test will be described below. No. 2-2 strand test is a test for verifying the effects of stranded conductors manufactured from hard filaments formed from an aluminum alloy material having a higher strength than a pure aluminum-based material having a composition corresponding to that of JIS H4000 1070.

First, as test specimens B formed in No. 2-2 strand test, test specimens Ba1 to Bi1, Ba2 to Bi2, Ba3 to Bi3, Ba4 to Bi4, Ba5 to Bi5, Ba6 to Bi6, and Ba7 to Bi7 were used. For each of these specimens, the lay length Pb and the tension applied to the hard filaments were the same as those in No. 2-1 strand test, described above.

No. 2-2 strand test was conducted by using the test specimens described above. The results of the evaluation are shown in Table 4 below.

TABLE 2-2

| Tension (N) | Lay length (coefficient) | | | | | | | | |
|---|---|---|---|---|---|---|---|---|---|
| Filaments | 5.1 | 5.9 | 6.4 | 8.6 | 9.6 | 15.4 | 16.9 | 17.8 | 18.7 |
| 4.5 | D | D | C | C | B | B | C | D | D |
| | Ba1 | Bb1 | Bc1 | Bd1 | Be1 | Bf1 | Bg1 | Bh1 | Bi1 |
| 5.0 | D | D | B | B | A | A | B | D | D |
| | Ba2 | Bb2 | Bc2 | Bd2 | Be2 | Bf2 | Bg2 | Bh2 | Bi2 |
| 5.5 | D | D | B | B | A | A | B | D | D |
| | Ba3 | Bb3 | Bc3 | Bd3 | Be3 | Bf3 | Bg3 | Bh3 | Bi3 |
| 6.0 | D | D | B | B | A | A | B | D | D |
| | Ba4 | Bb4 | Bc4 | Bd4 | Be4 | Bf4 | Bg4 | Bh4 | Bi4 |
| 6.5 | D | C | B | B | A | A | B | D | D |
| | Ba5 | Bb5 | Bc5 | Bd5 | Be5 | Bf5 | Bg5 | Bh5 | Bi5 |
| 7.0 | D | C | B | B | A | A | B | C | D |
| | Ba6 | Bb6 | Bc6 | Bd6 | Be6 | Bf6 | Bg6 | Bh6 | Bi6 |
| 7.5 | D | D | C | C | B | B | C | D | D |
| | Ba7 | Bb7 | Bc7 | Bd7 | Be7 | Bf7 | Bg7 | Bh7 | Bi7 |

The results are as follows. Table 2-2 above shows that the occurrence of defects, such as strand unevenness of hard filaments, outward protrusion of hard filaments, and elongation or breakage of hard filaments, was inhibited in test specimens Bc2 to Bg2, Bc3 to Bg3, Bc4 to Bg4, Bc5 to Bg5, and Bc6 to Bg6, and further that the stranding was accomplished with a desired lay length Pb over all sections of test specimen, in test specimens Be2 to Be6, and Bf2 to Bf6.

On the other hand, strand unevenness of hard filaments occurred in test specimens Ba1 to Ba7 and Bb1 to Bb1, and outward protrusion of hard filaments occurred in test specimens Bh1 to Bh7 and Bi1 to Bi7.

Further, strand unevenness of hard filaments occurred in some of test specimens Ba1 to Bi1 and elongation or breakage of hard filaments occurred in some of test specimens Ba1 to Bi7.

From the above, the following was found. For the stranded conductor to be obtained by stranding together hard filaments formed from a high-strength aluminum alloy material, the stranding can be performed under the same manufacturing conditions as those for the stranded conductor 1*b*, which is obtained by stranding together the above-described hard filaments 2*b* formed from a pure aluminum-based material having a composition corresponding to that of JIS H4000 1070. This more reliably prevents the occurrence of the defects described above. Consequently, a desired stranded conductor is manufactured.

Second Embodiment

A second embodiment of this invention will be described with reference to FIGS. 8 to 11. Of the elements to be described below, elements similar to those of the above-described first embodiment are assigned the same reference characters and descriptions thereof are omitted.

Figure 8:
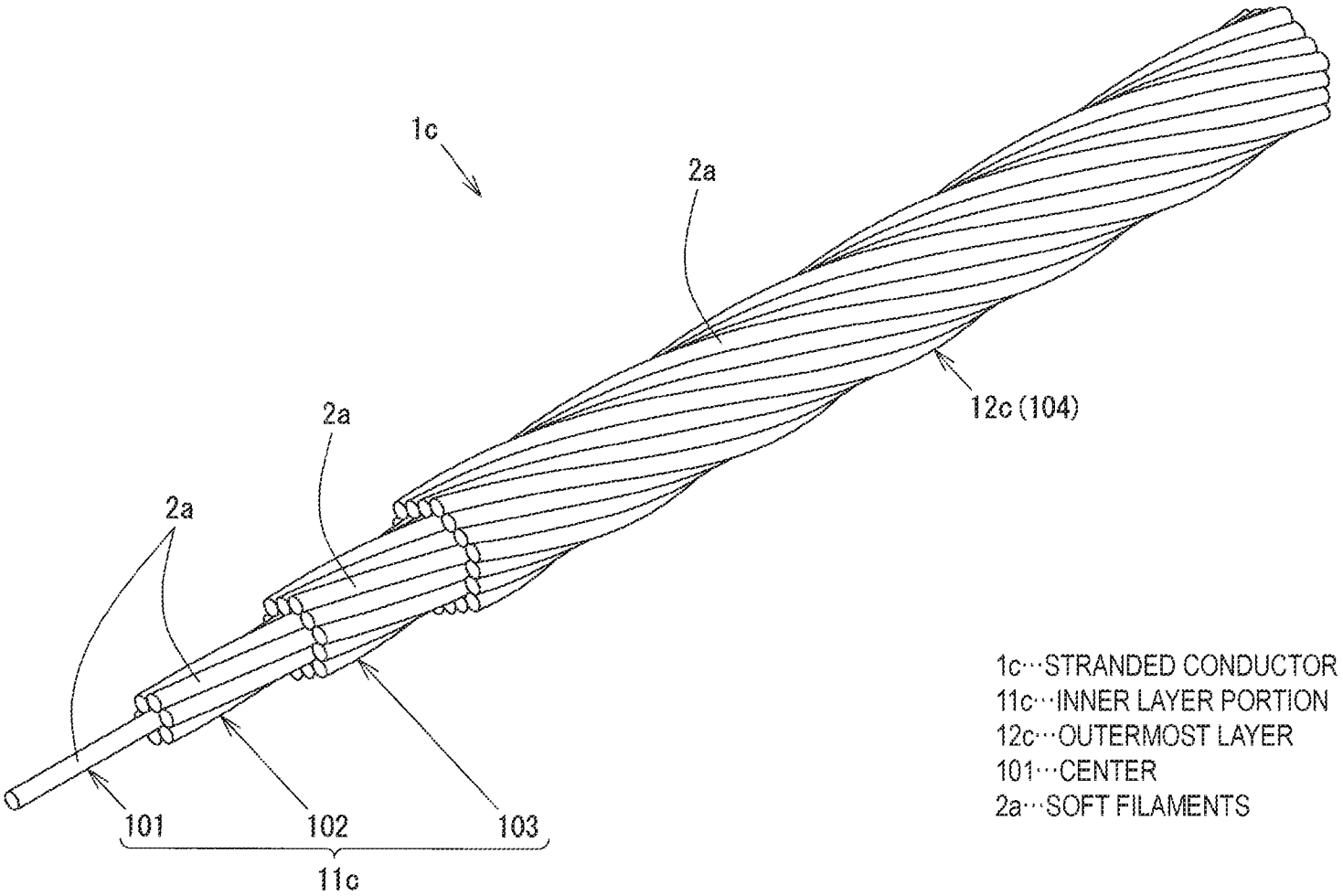
FIG. 8 is a perspective view of a stranded conductor according to a second embodiment.
Figure 9:
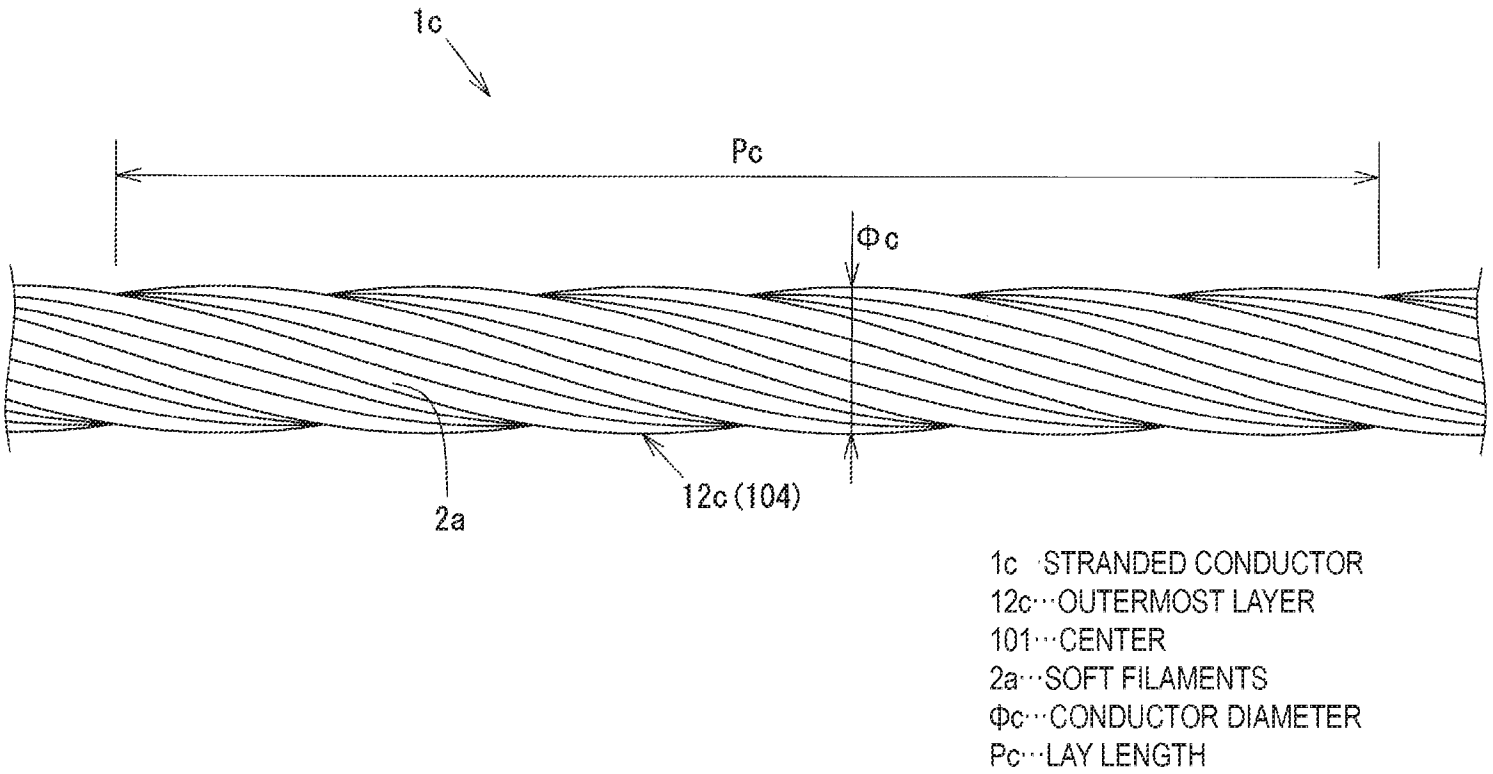
FIG. 9 is a front view of the stranded conductor according to the second embodiment.
Figure 10:
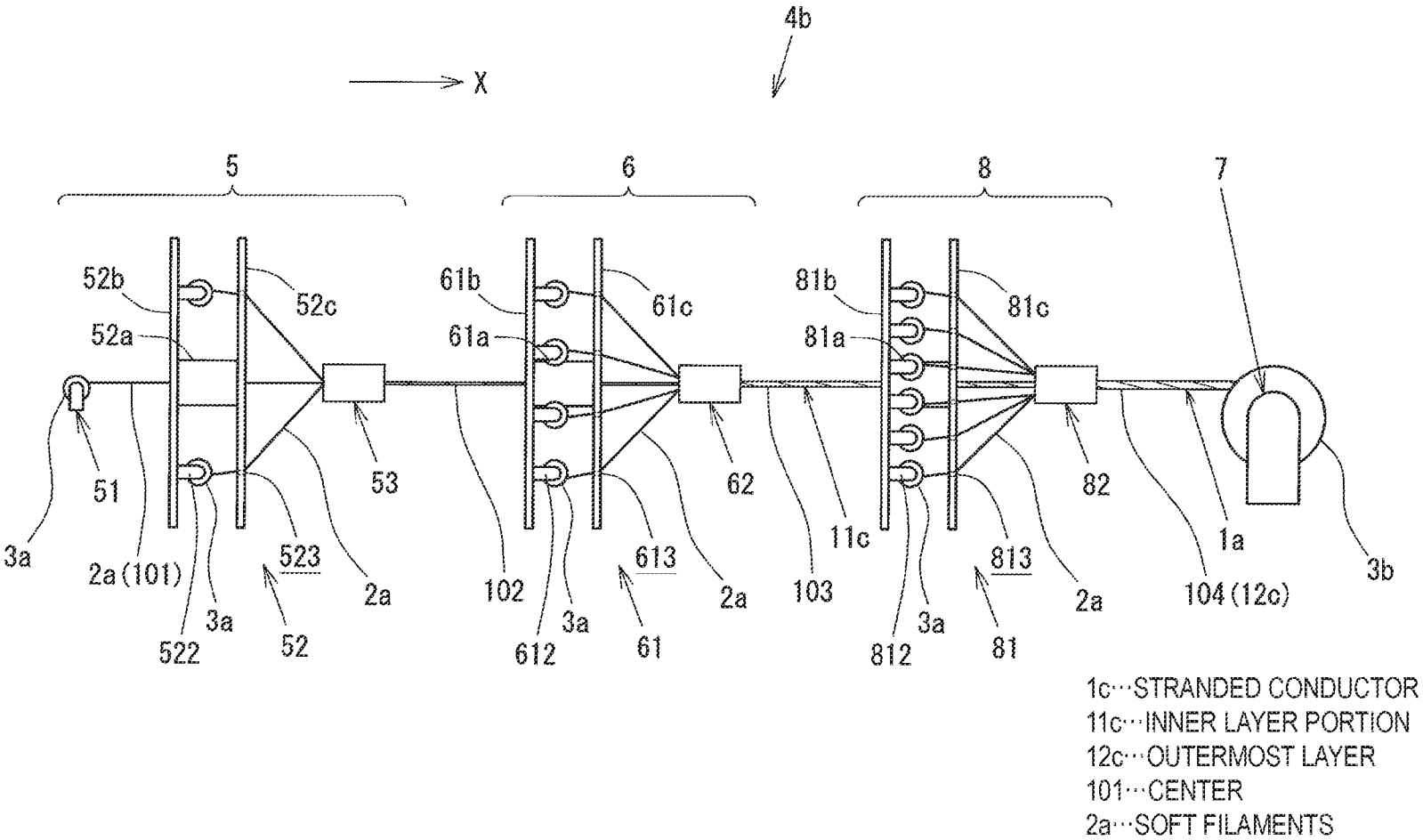
FIG. 10 is a schematic diagram of a stranding machine according to the second embodiment.
Figure 11:
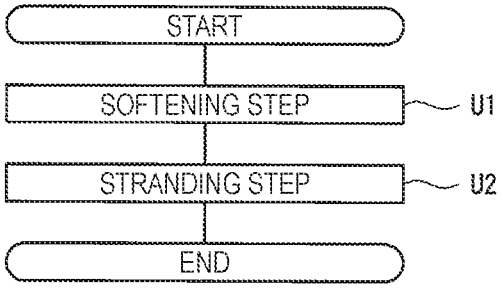
FIG. 11 is a flowchart illustrating a method for manufacturing the stranded conductor according to the second embodiment.

FIG. 8 is a perspective view of a stranded conductor 1*c*, according to the second embodiment. FIG. 9 is a front view of the stranded conductor 1*c* according to the second embodiment. FIG. 10 is a schematic diagram of a stranding machine 4*b*, according to the second embodiment. FIG. 11 is a flowchart illustrating a method for manufacturing the stranded conductor 1*c* according to the second embodiment.

FIG. 8 is a perspective view of the stranded conductor 1*c*. To ensure that the 4-layer structure of the stranded conductor 1*c* can be easily understood, the lengths of the soft filaments 2*a* are illustrated, at one end of the stranded conductor 1*c*, in such a manner that the length decreases gradually, from the center 101 toward a fourth layer 104.

FIG. 10 is a schematic diagram of the stranding machine 4*b*. FIG. 10 is simplified so that it can be easily understood that the number of second bobbin attachment portions 522, the number of third bobbin attachment portions 612, and the number of fourth bobbin attachment portions 812 are different from one another. Bobbins 3*a* can be attached to the second bobbin attachment portions 522, the third bobbin attachment portions 612, and fourth bobbin attachment portions 812.

The stranded conductor 1*c* according to the second embodiment is formed as a 4-layer structure in which, as illustrated in FIG. 8, thirty-seven softened soft filaments 2*a* are concentrically disposed with the center 101 serving as the first layer. The soft filaments 2*a* are formed from a pure aluminum-based material having a composition corresponding to that of JIS H4000 1070. The radially inner three layers form an inner layer portion 11*c* and the layer outside of the inner layer portion 11*c* forms an outermost layer 12*c*.

Accordingly, a conductor diameter φc is 2.24 mm (see FIG. 9). The total cross-sectional area of the soft filaments 2*a*, as stranded together, is approximately 3.0 $mm^2$ (3 sq).

Specifically, the stranded conductor 1*c* is formed of the center 101 (corresponding to the first layer), the second layer 102, the third layer 103, and the fourth layer 104. The fourth layer 104 is formed of eighteen soft filaments 2*a*, which are disposed outside of the third layer 103. The layers from the center 101 to the third layer 103 form the inner layer portion 11*c* and the fourth layer 104 forms the outermost layer 12*c*.

As illustrated in FIG. 9, the stranded conductor 1*c* is configured such that a lay length Pc is 19.4 mm, which is approximately 8.7 times the conductor diameter φc.

The stranded conductor 1*c* may not necessarily be configured such that the lay length Pc is approximately 8.7 times the conductor diameter φc. It is sufficient that the lay length Pc be from 6.2 times to 15.7 times the conductor diameter φc and more preferably be from 8.7 times to 14.8 times the conductor diameter φc.

As illustrated in FIG. 10, the stranding machine 4*b* for stranding the stranded conductor 1*c* is formed by the second layer stranding unit 5, the third layer stranding unit 6, a fourth layer stranding unit 8, which is used to strand the fourth layer 104, and the conductor coiling unit 7, which are disposed in this order in the travel direction X.

The fourth layer stranding unit 8 is formed by a fourth layer stranding member 81 and a fourth layer collect chuck 82. The fourth layer stranding member 81 and the fourth layer collect chuck 82 have the same configuration as the second layer stranding member 52 and the second layer collect chuck 53 of the second layer stranding unit 5, and are thus not illustrated and will be briefly described below.

The fourth layer stranding member 81 is integrally formed by an axial core 81*a*, a first flange 81*b*, and a second flange 81*c*. The fourth layer stranding member 81 includes a rotation mechanism, which is not illustrated.

The axial core 81*a* is formed in a cylindrical shape and has therein a through hole 811, which extends through the axial core 81*a* along the travel direction X.

The first flange 81*b* includes eighteen fourth bobbin attachment portions 812, and the second flange 81*c* includes eighteen insertion holes 813 formed therein.

The fourth bobbin attachment portions 812 and the insertion holes 813 are each disposed to be evenly spaced on a concentric circle, in other words, disposed to form a substantially regular octadecagonal shape, when viewed in the travel direction X, at positions where the fourth bobbin attachment portions 812 and the insertion holes 813 face each other.

The rotation mechanism included in the fourth layer stranding member 81 has the same configuration as the rotation mechanism included in the above-described second layer stranding member 52. The axial core 81*a* is provided with the rotation mechanism.

The axial core 81*a* may be provided with the rotation mechanism, but this is not a limitation, as with the rotation mechanism included in the second layer stranding member 52.

The fourth layer collect chuck 82 is formed in a cylindrical shape and has an inside diameter similar to the outside diameter of the fourth layer 104, that is, to the diameter of the stranded conductor 1*c*. The fourth layer collect chuck 82 is used to collect eighteen soft filaments 2*a*, which pass through the insertion holes 813, around the inner layer portion 11*c*, which passes through the through hole 811.

A method for manufacturing the stranded conductor 1*c* by using the stranding machine 4*c*, configured as described above, will be described below.

As illustrated in FIG. 11, the stranded conductor 1*c* is manufactured by performing a softening step (step U1) and thereafter performing a stranding step (step U2).

The softening step (step U1) in the method for manufacturing the stranded conductor 1*c* is similar to the softening step (step S1) in the above-described method for manufacturing the stranded conductor 1*a* and is thus not described.

In the stranding step (step U2), first, bobbins 3*a* on which softened soft filaments 2*a* are wound are attached to the first bobbin attachment portion 51, the second bobbin attachment portions 522, the third bobbin attachment portions 612, and the fourth bobbin attachment portion 812.

The leading ends of the soft filaments 2*a*, as unwound from the bobbins 3*a* attached on the respective bobbin attachment portions, are passed through the predetermined portions and bundled together, and in this state, are secured to the bobbin 3*b* attached on the conductor coiling unit 7.

After securement of the soft filaments 2*a* to the bobbins 3*b* is completed, the first bobbin attachment portion 51, the second bobbin attachment portions 522, the third bobbin attachment portions 612, the fourth bobbin attachment portions 812, and the conductor coiling unit 7 are caused to rotate while causing the second layer stranding member 52, the third layer stranding member 61, and the fourth layer stranding member 81 to revolve in the same direction.

During this, a tension of 2.0 N is applied to each of the soft filaments 2*a* to be stranded together, by controlling the rotation speeds of the first bobbin attachment portion 51, the second bobbin attachment portions 522, the third bobbin attachment portions 612, and the fourth bobbin attachment portions 812, in accordance with the rotation speed of the conductor coiling unit 7.

The tension to be applied to the soft filaments 2*a* may not necessarily be 2.0 N and may be appropriately set to a range from 1.5 N to 2.5 N.

Furthermore, the revolution speeds of the second layer stranding member 52, the third layer stranding member 61, and the fourth layer stranding member 81 are controlled in accordance with the rotation speed of the conductor coiling unit 7, to strand together the soft filaments 2*a* with the lay length Pc of 19.4 mm, which is approximately 8.7 times the conductor diameter φc.

In the present embodiment, the revolution speeds of the second layer stranding member 52, the third layer stranding member 61, and the fourth layer stranding member 81 are the same, and thereby, the lay lengths for the second layer, the third layer, and the fourth layer can be the same lay length, Pc.

The stranding step (step U2), described above, is continued until a desired length of the stranded conductor 1*c* is reached.

As described above, the stranded conductor 1*c* is formed of a soft filament 2*a* made of an aluminum material, which is disposed along the center 101, and six soft filaments 2*a*, twelve soft filaments 2*a*, and eighteen soft filaments 2*a* that are sequentially disposed around and concentrically with the center 101. The soft filaments 2*a* are stranded together. The soft filaments 2*a* are softened filaments. The lay length Pc is approximately 8.7 times the conductor diameter φc, which corresponds to from 6.2 times to 15.7 times. As a result, the desired stranded conductor 1*c* is formed in which the occurrence of defects, such as strand unevenness of soft filaments 2*a* and outward protrusion of soft filaments 2*a*, is inhibited.

Since the lay length Pc of the stranded conductor 1*c* is from 8.7 times to 14.8 times the conductor diameter φc, the desired stranded conductor 1*c* is formed in which the occurrence of defects, such as strand unevenness of soft filaments 2*a* and protrusion of soft filaments 2*a*, is reliably prevented.

Further, in the stranding step, a tension of 2.0 N, which corresponds to from 1.5 N to 2.5 N, is applied to the soft filaments 2*a*, and thus, the soft filaments 2*a* can be stranded together with a predetermined lay length Pc without slackening. As a result, the desired stranded conductor 1*c* is manufactured in which the occurrence of defects, such as strand unevenness of soft filaments 2*a* and outward protrusion of soft filaments 2*a*, is prevented.

In the following, No. 3-1 strand test will be described. No. 3-1 strand test is a test for verifying the effects of the stranded conductor 1*c*, which produces effects such as described above.

No. 3-1 strand test is a test for evaluating a stranded conductor (designated as test specimen C) formed of thirty-seven soft filaments 2*a*, stranded together by performing the stranding step of stranding each of the layers, sequentially from the center 101 to the fourth layer 104.

First, as test specimens C formed in No. 3-1 strand test, the following were used: test specimen Ca, having a lay length Pc of 5.3 times the conductor diameter φc; test specimen Cb, 5.6 times; test specimen Cc, 6.2 times; test specimen Cd, 7.9 times; test specimen Ce, 8.7 times; test specimen Cf, 14.8 times; test specimen Cg, 15.5 times; test specimen Ch, 15.7 times; test specimen Ci, 18.2 times; and test specimen Cj, 22.7 times.

Further, as test specimens Ca, described above, the following were used, for each of which the tension was applied to the soft filaments 2*a*: test specimen Ca1, manufactured while applying a tension of 1.0 N; test specimen Ca2, manufactured while applying a tension of 1.5 N; test specimen Ca3, manufactured while applying a tension of 2.0 N; test specimen Ca4, manufactured while applying a tension of 2.5 N; and test specimen Ca5, manufactured while applying a tension of 3.0 N.

Further, as test specimens Cb to Cj, the following were used: test specimens Cb1 to Cb5; test specimens Cc1 to Cc5; test specimens Cd1 to Cd5; test specimens Ce1 to Ce5; test specimens Cf1 to Cf5; test specimens Cg1 to Cg5; test specimens Ch1 to Ch5; test specimens Ci1 to Ci5; and test specimens Cj1 to Cj5. For these test specimens, the tension applied to the soft filaments 2*a* was varied in the same manner as that for test specimens Ca.

In No. 3-1 strand test, for each type of specimen described above, ten specimens were manufactured as with No. 1-1 strand test, described above, and the presence or absence of defects was evaluated from the appearances of five randomly selected specimens. The results of the evaluation are shown in Table 3-1 below.

TABLE 3-1

| Tension (N) | Lay length (coefficient) | | | | | | | | | |
|---|---|---|---|---|---|---|---|---|---|---|
| Filaments | 5.3 | 5.6 | 6.2 | 7.9 | 8.7 | 14.8 | 15.5 | 15.7 | 18.2 | 22.7 |
| 1.0 | D<br>Ca1 | D<br>Cb1 | C<br>Cc1 | C<br>Cd1 | B<br>Ce1 | B<br>Cf1 | C<br>Cg1 | C<br>Ch1 | D<br>Ci1 | D<br>Cj1 |
| 1.5 | D<br>Ca2 | D<br>Cb2 | B<br>Cc2 | B<br>Cd2 | A<br>Ce2 | A<br>Cf2 | B<br>Cg2 | B<br>Ch2 | D<br>Ci2 | D<br>Cj2 |
| 2.0 | D<br>Ca3 | C<br>Cb3 | B<br>Cc3 | B<br>Cd3 | A<br>Ce3 | A<br>Cf3 | B<br>Cg3 | B<br>Ch3 | D<br>Ci3 | D<br>Cj3 |
| 2.5 | D<br>Ca4 | C<br>Cb4 | B<br>Cc4 | B<br>Cd4 | A<br>Ce4 | A<br>Cf4 | B<br>Cg4 | B<br>Ch4 | C<br>Ci4 | D<br>Cj4 |
| 3.0 | D<br>Ca5 | D<br>Cb5 | C<br>Cc5 | C<br>Cd5 | B<br>Ce5 | B<br>Cf5 | C<br>Cg5 | C<br>Ch5 | D<br>Ci5 | D<br>Cj5 |

The results are as follows. Table 3-1 above shows that the occurrence of defects, such as strand unevenness of soft filaments 2*a*, outward protrusion of soft filaments 2*a*, and elongation or breakage of soft filaments 2*a*, was inhibited in test specimens Cc2 to Ch2, Cc3 to Ch3, and Cc4 to Ch4, and further that the stranding was accomplished with a desired lay length Pc over all sections of test specimen, in test specimens Ce2 to Ce4 and Cf2 to Cf4.

On the other hand, strand unevenness of soft filaments 2*a* occurred in test specimens Ca1 to Ca5 and Cb1 to Cb5, and outward protrusion of soft filaments 2*a* that form the inner layer portion 11*c* occurred in test specimens Ci1 to Ci5 and Cj1 to Cj5.

Further, strand unevenness of soft filaments 2*a* occurred in some of test specimens Ca1 to Cj1 and elongation or breakage of soft filaments 2*a* occurred in some of test specimens Ca5 to Cj5.

From the above, the following was observed. For the stranded conductor 1*c*, formed of thirty-seven soft filaments 2*a* stranded together by performing the stranding step of stranding each of the layers sequentially from the center 101 to the fourth layer 104, the stranding can be performed while applying a tension from 1.5 N to 2.5 N to the soft filaments 2*a*, to thereby achieve a lay length Pc from 6.2 times to 15.7 times the conductor diameter φc. This inhibits the occurrence of the defects described above, and, in the case that the lay length Pc is from 8.7 times to 14.8 times the conductor diameter φc, prevents more reliably the occurrence of the defects described above.

In the description above, the stranded conductor 1*c* is formed of soft filaments 2*a* formed from a pure aluminum-based material having a composition corresponding to that of JIS H4000 1070. Instead, the stranded conductor may be formed of soft filaments obtained by softening filaments made of a high-strength aluminum alloy material containing magnesium and silicon added thereto and having an improved tensile strength compared with that of a pure aluminum-based material having a composition corresponding to that of JIS H4000 1070. In such a case, by stranding together the soft filaments while applying thereto a tension from 1.0 N to 4.5 N, the desired stranded conductor, stranded with a predetermined lay length Pc without slackening, is manufactured.

No. 3-2 strand test will be described below. No. 3-2 strand test is a test for verifying the effects of stranded conductors manufactured from soft filaments formed from an aluminum alloy material having a higher strength than a pure aluminum-based material having a composition corresponding to that of JIS H4000 1070.

First, as test specimens C formed in No. 3-2 strand test, test specimens Ca to Cj, each of which had the same lay length Pc as that in the above described No. 3-1 strand test, were used.

Further, as test specimens Ca, described above, the following were used, for each of which the tension was applied to soft filaments formed from a high-strength aluminum alloy material: test specimens Ca1 to Ca5, each manufactured while applying a similar tension to that of No. 3-1 strand test; test specimen Ca6, manufactured while applying a tension of 0.5 N; test specimen Ca7, manufactured while applying a tension of 3.5 N; test specimen Ca8, manufactured while applying a tension of 4.0 N; test specimen Ca9, manufactured while applying a tension of 4.5 N; and test specimen Ca10, manufactured while applying a tension of 5.0 N.

Further, as test specimens Cb to Cj, the following were used: test specimens Cb1 to Cb10; test specimens Cc1 to Cc10; test specimens Cd1 to Cd10; test specimens Ce1 to Ce10; test specimens Cf1 to Cf10; test specimens Cg1 to Cg10; test specimens Ch1 to Ch10; test specimens Ci1 to Ci10; and test specimens Cj1 to Cj10. For these test specimens, the tension applied to the soft filaments was varied in the same manner as that for test specimens Ca.

No. 3-2 strand test was conducted by using the test specimens described above. The results of the evaluation are shown in Table 3-2 below.

TABLE 3-2

| Tension (N) | Lay length (coefficient) | | | | | | | | | |
|---|---|---|---|---|---|---|---|---|---|---|
| Filaments | 5.3 | 5.6 | 6.2 | 7.9 | 8.7 | 14.8 | 15.5 | 15.7 | 18.2 | 22.7 |
| 0.5 | D<br>Ca6 | D<br>Cb6 | C<br>Cc6 | C<br>Cd6 | B<br>Ce6 | B<br>Cf6 | C<br>Cg6 | C<br>Ch6 | D<br>Ci6 | D<br>Cj6 |
| 1.0 | D<br>Ca1 | D<br>Cb1 | B<br>Cc1 | B<br>Cd1 | A<br>Ce1 | A<br>Cf1 | B<br>Cg1 | B<br>Ch1 | D<br>Ci1 | D<br>Cj1 |
| 1.5 | D<br>Ca2 | D<br>Cb2 | B<br>Cc2 | B<br>Cd2 | A<br>Ce2 | A<br>Cf2 | B<br>Cg2 | B<br>Ch2 | D<br>Ci2 | D<br>Cj2 |
| 2.0 | D<br>Ca3 | C<br>Cb3 | B<br>Cc3 | B<br>Cd3 | A<br>Ce3 | A<br>Cf3 | B<br>Cg3 | B<br>Ch3 | C<br>Ci3 | D<br>Cj3 |
| 2.5 | D<br>Ca4 | C<br>Cb4 | B<br>Cc4 | B<br>Cd4 | A<br>Ce4 | A<br>Cf4 | B<br>Cg4 | B<br>Ch4 | C<br>Ci4 | D<br>Cj4 |
| 3.0 | D<br>Ca5 | C<br>Cb5 | B<br>Cc5 | B<br>Cd5 | A<br>Ce5 | A<br>Cf5 | B<br>Cg5 | B<br>Ch5 | C<br>Ci5 | D<br>Cj5 |
| 3.5 | D<br>Ca7 | C<br>Cb7 | B<br>Cc7 | B<br>Cd7 | A<br>Ce7 | A<br>Cf7 | B<br>Cg7 | B<br>Ch7 | D<br>Ci7 | D<br>Cj7 |
| 4.0 | D<br>Ca8 | C<br>Cb8 | B<br>Cc8 | B<br>Cd8 | A<br>Ce8 | A<br>Cf8 | B<br>Cg8 | B<br>Ch8 | D<br>Ci8 | D<br>Cj8 |
| 4.5 | D<br>Ca9 | C<br>Cb9 | B<br>Cc9 | B<br>Cd9 | A<br>Ce9 | A<br>Cf9 | B<br>Cg9 | B<br>Ch9 | D<br>Ci9 | D<br>Cj9 |
| 5.0 | D<br>Ca10 | D<br>Cb10 | C<br>Cc10 | C<br>Cd10 | B<br>Ce10 | B<br>Cf10 | C<br>Cg10 | C<br>Ch10 | D<br>Ci10 | D<br>Cj10 |

The results are as follows. Table 3-2 above shows that the occurrence of defects, such as strand unevenness of soft filaments, outward protrusion of soft filaments, and elongation or breakage of soft filaments, was inhibited in test specimens Cc1 to Ch1, Cc2 to Ch2, Cc3 to Ch3, Cc4 to Ch4, Cc5 to Ch5, Cc7 to Ch7, Cc8 to Ch8, and Cc9 to Ch9, and further that the stranding was accomplished with a desired lay length Pc over all sections of test specimen, in test specimens Ce1 to Ce5, Ce1 to Ce9, Cf1 to Cf5, and Cf7 to Cf9.

On the other hand, strand unevenness of soft filaments occurred in test specimens Ca1 to Ca10 and Cb1 to Cb10, and outward protrusion of soft filaments that form the inner layer portion 11*c* occurred in test specimens Ci1 to Ci10 and Cj1 to Cj10.

Further, strand unevenness of soft filaments occurred in some of test specimens Ca6 to Cj6 and elongation or breakage of soft filaments occurred in some of test specimens Ca10 to Cj10.

From the above, the following was observed. For the stranded conductor formed of soft filaments formed from a high-strength aluminum alloy material, the stranding can be performed while applying a tension from 1.0 N to 4.5 N to the soft filaments, to thereby achieve a lay length Pc from 6.2 times to 15.7 times the conductor diameter φc. This inhibits the occurrence of the defects described above, and, in the case that the lay length Pc is from 8.7 times to 14.8 times the conductor diameter φc, prevents more reliably the occurrence of the defects described above.

Figure 12A:
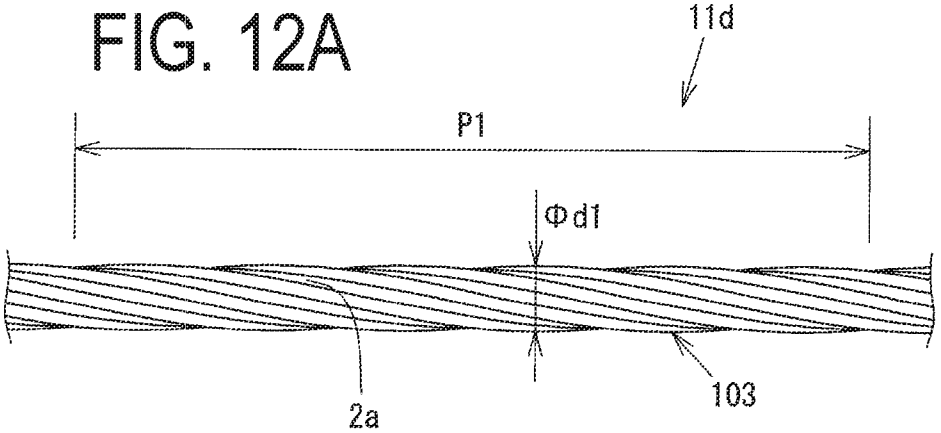
FIGS. 12A and 12B are diagrams illustrating a stranded conductor according to another embodiment.
Figure 12B:
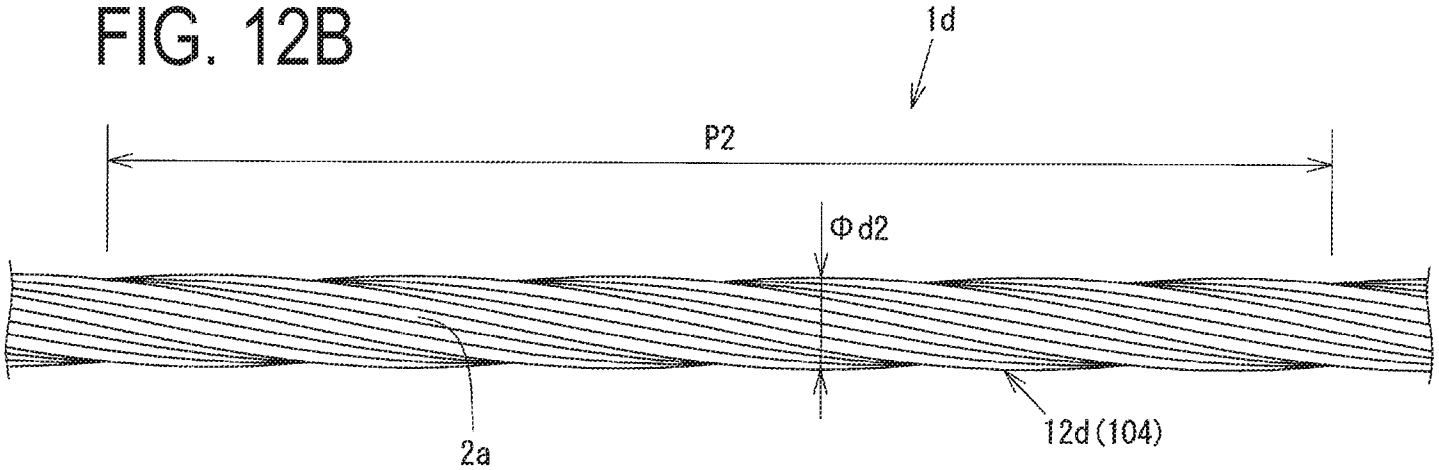

In the description above, the stranded conductor 1*c* is formed of thirty-seven soft filaments 2*a*, with the second layer 102, the third layer 103, and the fourth layer 104 sequentially stranded outside of the center 101 (manufactured by one step). Instead, a stranded conductor 1*d* may be formed by forming an inner layer portion 11*d*, as illustrated in FIG. 12A, and thereafter, stranding an outermost layer 12*d* (fourth layer 104), as illustrated in FIG. 12B (manufactured by two steps). The inner layer portion 11*d* includes the layers, from the center 101 to the third layer 103, stranded together.

That is, the stranded conductor 1*c* may be formed by performing a single stranding step, and in addition, the stranded conductor 1*d* may be formed by performing two stranding steps including an inner layer stranding step of stranding the inner layer portion 11*d* and an outer layer stranding step of stranding the outermost layer 12*d*.

FIG. 12A is a front view of the inner layer portion 11*d*, which is a constituent of the stranded conductor 1*d*, and FIG. 12B is a front view of the stranded conductor 1*d*.

The stranded conductor 1*d* is formed of soft filaments 2*a* formed from a pure aluminum-based material having a composition corresponding to that of JIS H4000 1070. As illustrated in FIG. 12A, an inner layer lay length P1, with which the inner layer portion 11*d* is stranded, is 19.4 mm, which is approximately 12.1 times an inner layer diameter φd1. The inner layer diameter φd1 is the diameter of the inner layer portion 11*d*. As illustrated in FIG. 12B, an outer layer lay length P2 is 29.9 mm, which is approximately 13.4 times a conductor diameter φd2. That is, the inner layer lay lengths P1 for the second layer 102 and the third layer 103 are the same, but the outer layer lay length P2, for the fourth layer 104, is different from the inner layer lay length P1 for the second layer 102 and the third layer 103.

The inner layer portion 11*d* has the same configuration as the stranded conductor 1*a* in the first embodiment. The inner layer lay length P1 may not necessarily be configured to be approximately 12.1 times the inner layer diameter φd1, and it is sufficient that the inner layer lay length P1 be from 8.6 times to 22.0 times the inner layer diameter φd1 and more preferably be from 12.1 times to 20.7 times the inner layer conductor diameter φd1.

The outermost layer 12*d* may not necessarily be configured such that the outer layer lay length P2 is approximately 13.4 times the conductor diameter φd2. It is sufficient that the outer layer lay length P2 be from 6.8 times to 22.7 times the conductor diameter φd2 and more preferably be from 7.5 times to 18.2 times the conductor diameter φd2.

When the outermost layer 12*d* is being stranded, the twisting load acts on the inner layer portion 11*d*. Thus, an inner layer lay length P3, which is a lay length after the outermost layer 12*d* is stranded, is a value determined by Equation (1) below. Specifically, the inner layer lay length P3 after the outermost layer 12*d* is stranded is approximately 11.8 mm. The inner layer lay length P3 is not illustrated because it is a lay length of the inner layer portion 11*d*, which is located radially inside in the stranded conductor 1*d*, illustrated in FIG. 12B.

[Equation 1]

$$P3 = \frac{P1 \times P2}{P1 + P2} \quad (1)$$

In Equation (1), P1 represents an inner layer lay length prior to formation of the outermost layer 12*d*, P2 represents the outer layer lay length, and P3 represents the inner layer lay length in the state in which the outermost layer 12*d* is formed.

Thus, the outermost layer 12*d* is stranded while the twisting load is being applied to the inner layer portion 11*d*, and as a result, the inner layer lay length is changed from 19.4 mm (inner layer lay length P1) to approximately 11.8 mm (inner layer lay length P3), which is a lay length different from the outer layer lay length P2 of 29.9 mm. In such a manner, the soft filaments 2*a* that form the inner layer portion 11*d* intersect the soft filaments 2*a* that form the outermost layer 12*d*.

A method for manufacturing the stranded conductor 1*d*, configured as described above, will be described below.

Figure 13A:
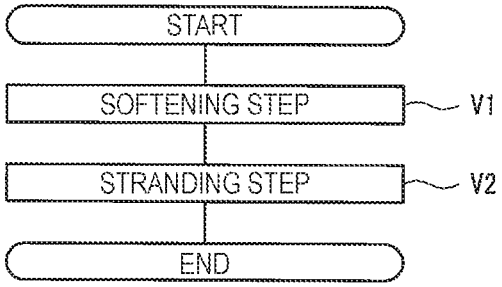
FIGS. 13A and 13B are flowcharts illustrating a method for manufacturing a stranded conductor according to another embodiment.

As illustrated in FIG. 13A, the stranded conductor 1*d* is manufactured by performing a softening step (step V1) and thereafter performing a stranding step (step V2).

FIG. 13A is a flowchart illustrating a method for manufacturing the stranded conductor 1*d*.

The softening step (step V1) in the method for manufacturing the stranded conductor 1*d* is similar to the softening step (step S1) in the method for manufacturing the stranded conductor 1*a* of the first embodiment and is thus not described.

Figure 13B:
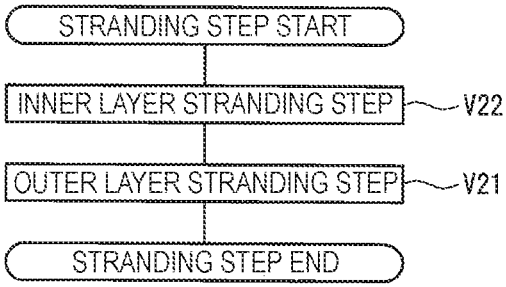

As illustrated in FIG. 13B, the stranding step (step V2) is carried out by performing an inner layer stranding step (step V22) of stranding the inner layer portion 11*d* and an outer layer stranding step (step V21) of stranding the fourth layer 104 (outer layer 12*d*) onto the outside of the inner layer portion 11*d*. The steps are performed in the order stated.

FIG. 13B is a flowchart illustrating the stranding step (step V2).

The inner layer stranding step (step V21) is similar to the stranding step in the method for manufacturing the stranded conductor 1*a* of the first embodiment and is thus not described.

The outer layer stranding step (step V22) is carried out as follows. While the inner layer portion 11*d*, wound on the bobbin 3*b* in the inner layer stranding step (step V21), is being unwound, soft filaments 2*a* that form the outermost layer 12*d* are stranded together onto the outside of the inner layer portion 11*d*.

During this, a tension of 50 N is applied to the inner layer portion 11*d* and a tension of 2.0 N is applied to each of the soft filaments 2*a* that form the outermost layer 12*d* (fourth layer 104).

The soft filaments 2*a* are stranded together with an outer layer lay length P2 of 29.9 mm, which is approximately 13.4 times the conductor diameter φd2.

The tension to be applied to the inner layer portion 11*d* may not necessarily be 50 N and may be appropriately set to a range from 20 N to 80 N. The tension to be applied to the soft filaments 2*a* may not necessarily be 2.0 N and may be appropriately set to a range from 1.5 N to 2.5 N.

The outer layer stranding step (step V22), described above, is continued until a desired length of the stranded conductor 1*d* is reached.

As described above, nineteen soft filaments 2*a* stranded together in the same manner as that for the stranded conductor 1*a* in the first embodiment serve as the inner layer portion 11*d*, and the outermost layer 12*d* is formed by disposing eighteen soft filaments 2*a* outside of, and concentrically with the inner layer portion 11*d*. The outer layer lay length P2 with which the outermost layer 12*d* is stranded, is approximately 13.4 times the conductor diameter φd2, which corresponds to from 6.8 times to 22.7 times. The inner layer lay length P1 for the inner layer portion 11*d*, in the state in which the outermost layer 12*d* is formed, is a value determined by Equation (1), described above. As a result, the desired stranded conductor 1*a* is formed in which the occurrence of defects, such as strand unevenness of soft filaments 2*a* and outward protrusion of soft filaments 2*a*, is inhibited.

Specifically, the outermost layer 12*d* is stranded while the twisting load is being applied to the inner layer portion 11*d*, and as a result, the inner layer lay length P1 is changed to the inner layer lay length P3, which is different from the outer layer lay length P2. Thus, the stranding is accomplished in such a manner that the soft filaments 2*a* that form the inner layer portion 11*d* intersect the soft filaments 2*a* that form the outermost layer 12*d*. Consequently, defects, such as outward protrusion of soft filaments 2*a*, are prevented.

Thus, the desired stranded conductor 1*d* is formed. Since the outer layer lay length P2 of the stranded conductor 1*d* is from 7.5 times to 18.2 times the conductor diameter φd2, the desired stranded conductor 1*d* is formed in which the occurrence of defects, such as strand unevenness of soft filaments 2*a* and protrusion of soft filaments 2*a*, is reliably prevented.

Furthermore, the stranding step is carried out by performing the inner layer stranding step of stranding the inner layer portion 11*d* and the outer layer stranding step of stranding the outermost layer 12*d*. The steps are performed in the order stated. In the outer layer stranding step, a tension of 2.0, which corresponds to from 1.5 N to 2.5 N, is applied to the soft filaments 2*a*, and a tension of 50 N, which corresponds to from 20 N to 80 N, is applied to the inner layer portion 11*d*. As a result, the soft filaments 2*a* that form the outermost layer 12*d* is reliably stranded with a desired outer layer lay length P2 without slackening. Consequently, the desired stranded conductor 1*d* is manufactured in which the occurrence of defects, such as strand unevenness of soft filaments 2*a* and outward protrusion of soft filaments 2*a*, is prevented.

Specifically, in a case where a tension of less than 20 N is applied to the inner layer portion 11*d* or no tension is applied to the inner layer portion 11*d* to carry out stranding, slackening may occur in the inner layer portion 11*d*.

On the other hand, in a case where a tension of greater than 80 N is applied to the inner layer portion 11*d* to carry out stranding, the soft filaments 2*a* that form the inner layer portion 11*d* may become elongated or broken.

Further, in a case where a tension of less than 1.5 N is applied to the soft filaments 2*a* or no tension is applied to the soft filaments 2*a* to carry out stranding, strand unevenness of soft filaments 2*a* that form the outermost layer 12*d* may occur or outward protrusion of soft filaments 2*a* that form the inner layer portion 11*d* may occur.

On the other hand, in a case where a tension of greater than 2.5 N is applied to the soft filaments 2*a* to carry out stranding, the soft filaments 2*a* may become elongated or broken.

In contrast, by applying a tension of 50 N, which corresponds to from 20 N to 80 N, to the inner layer portion 11*d* and applying a tension of 2.0 N, which corresponds to from 1.5 N to 2.5 N, to the soft filaments 2*a* that form the outermost layer 12*d* to carry out stranding, the soft filaments 2*a* that form the outermost layer 12*d* can be stranded together onto the inner layer portion 11*d*, which is in a properly tensioned state, with a predetermined outer layer lay length P2 without slackening. In addition, elongation or breakage of the soft filaments 2*a* that form the inner layer portion 11*d* and the soft filaments 2*a* that form the outermost layer 12*d* is prevented.

Consequently, the desired stranded conductor 1*d*, in which the occurrence of defects, such as strand unevenness of soft filaments 2*a* and outward protrusion of soft filaments 2*a*, is prevented, is stranded without slackening.

In the following, No. 4-1 strand test will be described. No. 4-1 strand test is a test for verifying the effects of the stranded conductor 1*d*, which produces effects such as described above.

No. 4-1 strand test, which is conducted as a test for verifying effects, is a test for evaluating a stranded conductor (designated as test specimen D) formed of thirty-seven soft filaments 2*a*, stranded together by performing the stranding step. The stranding step is carried out by performing the inner layer stranding step and thereafter performing the outer layer stranding step.

In No. 4-1 strand test, the inner layer stranding step is performed by using an inner layer portion 11*d* configured such that the inner layer lay length P1 is 12.1 times the inner layer diameter φd1 (the same configuration as the stranded conductor 1*a* in which the occurrence of the defects described above is inhibited, as observed from No. 1 strand test).

First, as test specimens D formed in No. 4-1 strand test, the following were used: test specimen Da, having an outer layer lay length P2 of 5.6 times the conductor diameter φd2; test specimen Db, 6.2 times; test specimen Dc, 6.8 times; test specimen Dd, 7.5 times; test specimen De, 18.2 times; test specimen Df, 22.7 times; test specimen Dg, 24.5 times; and test specimen Dh, 27.1 times.

Further, as test specimens Da, described above, the following were used, for each of which the tension was applied to the soft filaments 2*a* that formed the outermost layer 12*d* while applying a tension of 50 N to the inner layer portion 11*d*: test specimen Da1, stranded while applying a tension of 1.0 N; test specimen Da2, stranded while applying a tension of 1.5 N; test specimen Da3, stranded while applying a tension of 2.0 N; test specimen Da4, stranded while applying a tension of 2.5 N; and test specimen Da5, stranded while applying a tension of 3.0 N.

Further, as test specimens Db to Dh, the following were used: test specimens Db1 to Db5; test specimens Dc1 to Dc5; test specimens Dd1 to Dd5; test specimens De1 to De5; test specimens Df1 to Df5; test specimens Dg1 to Dg5; and test specimens Dh1 to Dh5. For these test specimens, the tension applied to the soft filaments 2*a* was varied in the same manner as that for test specimens Da.

In No. 4-1 strand test, for each type of specimen described above, ten specimens were manufactured as with No. 1-1 strand test, described above, and the presence or absence of defects was evaluated from the appearances of five randomly selected specimens. The results of the evaluation are shown in Table 4-1 below.

TABLE 4-1

| Tension (N) | | Outer layer lay length (coefficient) | | | | | | | |
|---|---|---|---|---|---|---|---|---|---|
| Filaments | Inner layer portion | 5.6 | 6.2 | 6.8 | 7.5 | 18.2 | 22.7 | 24.5 | 27.1 |
| 1.0 | 50 | D | D | C | B | B | C | D | D |
| | | Da1 | Db1 | Dc1 | Dd1 | De1 | Df1 | Dg1 | Dh1 |
| 1.5 | | D | D | B | A | A | B | D | D |
| | | Da2 | Db2 | Dc2 | Dd2 | De2 | Df2 | Dg2 | Dh2 |
| 2.0 | | D | C | B | A | A | B | D | D |
| | | Da3 | Db3 | Dc3 | Dd3 | De3 | Df3 | Dg3 | Dh3 |
| 2.5 | | D | C | B | A | A | B | C | D |
| | | Da4 | Db4 | Dc4 | Dd4 | De4 | Df4 | Dg4 | Dh4 |
| 3.0 | | D | D | C | B | B | C | D | D |
| | | Da5 | Db5 | Dc5 | Dd5 | De5 | Df5 | Dg5 | Dh5 |

The results are as follows. Table 4-1 above shows that the occurrence of defects, such as strand unevenness of soft filaments 2*a*, outward protrusion of soft filaments 2*a*, and elongation or breakage of soft filaments 2*a*, was inhibited in test specimens Dc2 to Df2, Dc3 to Df3, and Dc4 to Df4, and further that the stranding was accomplished with a desired outer layer lay length P2 over all sections of test specimen, in test specimens Dd2 to Dd4 and De2 to De4.

On the other hand, strand unevenness of soft filaments 2*a* occurred in test specimens Da1 to Da5 and Db1 to Db5, and outward protrusion of soft filaments 2*a* that form the inner layer portion 11*d* occurred in test specimens Dg1 to Dg5 and Dh1 to Dh5.

Further, strand unevenness of soft filaments 2*a* occurred in some of test specimens Da1 to Dh1 and elongation or breakage of soft filaments 2*a* occurred in some of test specimens Da5 to Dh5.

Next, as test specimens Da, described above, the following were used, for each of which the tension was applied while applying a tension of 2.0 N to the soft filaments 2*a* that formed the outermost layer 12*d*: test specimen Da6, for which a tension of 10 N was applied to the inner layer portion 11*d*; test specimen Da1, for which a tension of 20 N was applied to the inner layer portion 11*d*; test specimen Da8, for which a tension of 50 N was applied to the inner layer portion 11*d*; test specimen Da9, for which a tension of 80 N was applied to the inner layer portion 11*d*; and test specimen Da10, for which a tension of 90 N was applied to the inner layer portion 11*d*.

Further, as test specimens Db to Dh, the following were used: test specimens Db6 to Db10; test specimens Dc6 to Dc10; test specimens Dd6 to Dd10; test specimens De6 to De10; test specimens Df6 to Df10; test specimens Dg6 to Dg10; and test specimens Dh6 to Dh10. For these test specimens, the tension applied to the inner layer portion 11*d* was varied in the same manner as that for test specimens Da.

The results of the evaluation of each of the test specimens are shown in Table 4-2 below.

TABLE 4-2

| Tension (N) | | Outer layer lay length (coefficient) | | | | | | | |
|---|---|---|---|---|---|---|---|---|---|
| Filaments | Inner layer portion | 5.6 | 6.2 | 6.8 | 7.5 | 18.2 | 22.7 | 24.5 | 27.1 |
| 2.0 | 10 | D | D | C | B | B | C | D | D |
| | | Da6 | Db6 | Dc6 | Dd6 | De6 | Df6 | Dg6 | Dh6 |
| | 20 | D | D | B | A | A | B | D | D |
| | | Da7 | Db7 | Dc7 | Dd7 | De7 | Df7 | Dg7 | Dh7 |
| | 50 | D | D | B | A | A | B | D | D |
| | | Da8 | Db8 | Dc8 | Dd8 | De8 | Df8 | Dg8 | Dh8 |
| | 80 | D | C | B | A | A | B | C | D |
| | | Da9 | Db9 | Dc9 | Dd9 | De9 | Df9 | Dg9 | Dh9 |
| | 90 | D | D | C | B | B | C | D | D |
| | | Da10 | Db10 | Dc10 | Dd10 | De10 | Df10 | Dg10 | Dh10 |

The results are as follows. Table 4-2 above shows that the occurrence of the defects described above was inhibited in test specimens Dc7 to Df7, Dc8 to Df8, and Dc9 to Df9, and that the stranding was accomplished with a desired outer layer lay length P2 over all sections of test specimen, in test specimens Dd7 to Dd9 and De7 to De9.

On the other hand, strand unevenness of soft filaments 2*a* occurred in test specimens Da6 to Da10 and Db6 to Db10, and outward protrusion of soft filaments 2*a* that form the inner layer portion 11*d* occurred in test specimens Dg6 to Dg10 and Dh6 to Dh10.

Further, strand unevenness of soft filaments 2*a* occurred in some of test specimens Da6 to Dh6 and elongation or breakage of soft filaments 2*a* occurred in some of test specimens Da10 to Dh10.

From the above, the following was observed. For the stranded conductor 1*d*, formed of thirty-seven soft filaments 2*a* stranded together by performing the stranding step of performing the inner layer stranding step and thereafter performing the outer layer stranding step, the stranding can be performed while applying a tension from 20 N to 80 N to the inner layer portion 11*d* having an inner layer lay length P1 of 12.1 times the inner layer diameter φd1 and applying a tension from 1.5 N to 2.5 N to the soft filaments 2*a* that form the outermost layer 12*d*, to thereby achieve an outer layer lay length P2 from 6.8 times to 22.7 times the conductor diameter φd2. This inhibits the occurrence of the defects described above, and, in the case that the outer layer lay length P2 is from 7.5 times to 18.2 times the conductor diameter φd2, prevents more reliably the occurrence of the defects described above.

Although not described in detail, No. 4-1 strand test was conducted by using the inner layer portion 11*d* having the inner layer lay length P1 of 12.1 times the inner layer diameter φd1, whereas when an inner layer portion 11*d* having an inner layer lay length P1 from 12.1 times to 20.7 times the inner layer diameter φd1 was used, the same evaluation results as those described above were obtained.

In contrast, it was observed that, regarding stranded conductors 1*d* formed with an inner layer lay length P1 smaller than 8.6 times the inner layer diameter φd1 or larger than 22.0 times the inner layer diameter φd1 (those having the same configuration as stranded conductors 1*a* in which a defect such as described above occurred, as observed from No. 1 test), a defect such as described above occurred regardless of what conditions were used to strand the outermost layer 12*d*.

Thus, it was found that, for the stranded conductor 1*d*, which is formed by performing the inner layer stranding step and thereafter performing the outer layer stranding step, it is suitable to strand the outermost layer 12*d* onto an inner layer portion 11*d* having an inner layer lay length P1 from 8.6 times to 22.0 times the inner layer diameter φd1 and more preferably from 12.1 times to 20.7 times the inner layer diameter φd1.

In the description above, the stranded conductor 1*d* is formed of soft filaments 2*a* formed from a pure aluminum-based material having a composition corresponding to that of JIS H4000 1070. Instead, the stranded conductor may be formed of soft filaments obtained by softening filaments made of a high-strength aluminum alloy material containing magnesium and silicon added thereto and having an improved tensile strength compared with that of a pure aluminum-based material having a composition corresponding to that of JIS H4000 1070. In such a case, by performing stranding while applying a tension from 1.0 N to 4.5 N to the soft filaments that form the outermost layer and applying a tension from 20 N to 150 N to the inner layer portion, a desired stranded conductor is manufactured which includes the outermost layer stranded with a predetermined outer layer lay length P2 without slackening.

No. 4-2 strand test will be described below. No. 4-2 strand test is a test for verifying the effects of stranded conductors manufactured from soft filaments formed from an aluminum alloy material having a higher strength than a pure aluminum-based material having a composition corresponding to that of JIS H4000 1070.

First, as test specimens D formed in No. 4-2 strand test, test specimens Da to Dh, each of which had the same outer layer lay length P2 as that in No. 4-1 strand test, described above, were used.

Further, as test specimens Da, described above, the following were used, for each of which the tension was applied to soft filaments formed from high-strength aluminum which formed the outermost layer, while applying a tension of 70 N to the inner layer portion: test specimen Da1 to Da5, each stranded while applying a similar tension to that in No. 4-1 strand test; test specimen Da11, stranded while applying a tension of 0.5 N; test specimen Da12, manufactured while applying a tension of 4.0 N; test specimen Da13, stranded while applying a tension of 4.5 N; and test specimen Da14, stranded while applying a tension of 5.0 N.

Further, as test specimens Db to Dh, the following were used: test specimens Db1 to Db5 and Db11 to Db15; test specimens Dc1 to Dc5 and Dc11 to Dc15; test specimens Dd1 to Dd5 and Dd11 to Dd15; test specimens De1 to De5 and De11 to De15; test specimens Df1 to Df5 and Df11 to Df15; test specimens Dg1 to Dg5 and Dg11 to Dg15; and test specimens Dh1 to Dh5 and Dh11 to Dh15. For these test specimens, the tension applied to the soft filaments was varied in the same manner as that for test specimens Da.

No. 4-2 strand test was conducted by using the test specimens described above. The results of the evaluation are shown in Table 4-3 below.

TABLE 4-3

| Tension (N) | | Outer layer lay length (coefficient) | | | | | | | |
|---|---|---|---|---|---|---|---|---|---|
| Filaments | Inner layer portion | 5.6 | 6.2 | 6.8 | 7.5 | 18.2 | 22.7 | 24.5 | 27.1 |
| 0.5 | 70 | D | D | C | B | B | C | D | D |
| | | Da11 | Db11 | Dc11 | Dd11 | De11 | Df11 | Dg11 | Dh11 |
| 1.0 | | D | C | B | A | A | B | D | D |
| | | Da1 | Db1 | Dc1 | Dd1 | De1 | Df1 | Dg1 | Dh1 |
| 1.5 | | D | C | B | A | A | B | D | D |
| | | Da2 | Db2 | Dc2 | Dd2 | De2 | Df2 | Dg2 | Dh2 |
| 2.0 | | D | C | B | A | A | B | D | D |
| | | Da3 | Db3 | Dc3 | Dd3 | De3 | Df3 | Dg3 | Dh3 |
| 2.5 | | D | C | B | A | A | B | D | D |
| | | Da4 | Db4 | Dc4 | Dd4 | De4 | Df4 | Dg4 | Dh4 |
| 3.0 | | D | C | B | A | A | B | D | D |
| | | Da5 | Db5 | Dc5 | Dd5 | De5 | Df5 | Dg5 | Dh5 |
| 4.0 | | D | C | B | A | A | B | C | D |
| | | Da12 | Db12 | Dc12 | Dd12 | De12 | Df12 | Dg12 | Dh12 |
| 4.5 | | D | C | B | A | A | B | C | D |
| | | Da13 | Db13 | Dc13 | Dd13 | De13 | Df13 | Dg13 | Dh13 |
| 5.0 | | D | D | C | B | B | C | D | D |
| | | Da14 | Db14 | Dc14 | Dd14 | De14 | Df14 | Dg14 | Dh14 |

The results are as follows. Table 4-3 above shows that the occurrence of defects, such as strand unevenness of soft filaments, outward protrusion of soft filaments, and elongation or breakage of soft filaments, was inhibited in test specimens Dc1 to Df1, Dc2 to Df2, Dc3 to Df3, Dc4 to Df4, Dc5 to Df5, Dc12 to Df12, and Dc13 to Df13, and further that the stranding was accomplished with a desired outer layer lay length P2 over all sections of test specimen, in test specimens Dd1 to Dd5, Dd12, Dd13, De1 to De5, De12, and De13.

On the other hand, strand unevenness of soft filaments occurred in test specimens Da1 to Da5, Da11 to Da14, Db1 to Db5, and Db11 to Db14, and outward protrusion of soft filaments that form the inner layer portion occurred in test specimens Dg1 to Dg5, Dg11 to Dg14, Dh1 to Dh5, and Dh11 to Dh14.

Further, strand unevenness of soft filaments occurred in some of test specimens Da11 to Dh11 and elongation or breakage of soft filaments occurred in some of test specimens Da14 to Dh14.

Next, as test specimens Da, described above, the following were used, for each of which the tension was applied while applying a tension of 2.5 N to soft filaments formed from a high-strength aluminum alloy material which formed the outermost layer: test specimen Da15, for which a tension of 10 N was applied to the inner layer portion; test specimen Da16, for which a tension of 20 N was applied to the inner layer portion; test specimen Da17, for which a tension of 70 N was applied to the inner layer portion; test specimen Da18, for which a tension of 150 N was applied to the inner layer portion; and test specimen Da19, for which a tension of 160 N was applied to the inner layer portion.

Further, as test specimens Db to Dh, the following were used: test specimens Db15 to Db19; test specimens Dc15 to Dc19; test specimens Dd15 to Dd19; test specimens De15 to De19; test specimens Df15 to Df19; test specimens Dg15 to Dg19; and test specimens Dh15 to Dh19. For these test specimens, the tension applied to the inner layer portion 11*d* was varied in the same manner as that for test specimens Da.

The results of the evaluation of each of the test specimens are shown in Table 4-4 below.

TABLE 4-4

| Tension (N) | | Outer layer lay length (coefficient) | | | | | | | |
|---|---|---|---|---|---|---|---|---|---|
| Filaments | Inner layer portion | 5.6 | 6.2 | 6.8 | 7.5 | 18.2 | 22.7 | 24.5 | 27.1 |
| 2.5 | 10 | D Da15 | D Db15 | C Dc15 | B Dd15 | B De15 | C Df15 | D Dg15 | D Dh15 |
| | 20 | D Da16 | D Db16 | B Dc16 | A Dd16 | A De16 | B Df16 | D Dg16 | D Dh16 |
| | 70 | D Da17 | D Db17 | B Dc17 | A Dd17 | A De17 | B Df17 | D Dg17 | D Dh17 |
| | 150 | D Da18 | C Db18 | B Dc18 | A Dd18 | A De18 | B Df18 | C Dg18 | D Dh18 |
| | 160 | D Da19 | D Db19 | C Dc19 | B Dd19 | B De19 | C Df19 | D Dg19 | D Dh19 |

The results are as follows. Table 4-4 above shows that the occurrence of the defects described above was inhibited in test specimens Dc16 to Df16, Dc17 to Df17, and Dc18 to Df18, and that the stranding was accomplished with a desired outer layer lay length P2 over all sections of test specimen, in test specimens Dd16 to Dd18 and De16 to De18.

On the other hand, strand unevenness of soft filaments occurred in test specimens Da15 to Da19 and Db15 to Db19, and outward protrusion of soft filaments that form the inner layer portion occurred in test specimens Dg15 to Dg19 and Dh15 to Dh19.

Further, strand unevenness of soft filaments occurred in some of test specimens Da15 to Dh15 and elongation or breakage of soft filaments occurred in some of test specimens Da19 to Dh19.

From the above, the following was observed. For the stranded conductor manufactured from soft filaments formed from a high-strength aluminum alloy material, the stranding can be performed while applying a tension from 20 N to 150 N to the inner layer portion having an inner layer lay length P1 of 12.1 times the inner layer diameter φd1 and applying a tension from 1.0 N to 4.5 N to the soft filaments that form the outermost layer, to thereby achieve an outer layer lay length P2 from 6.8 times to 22.7 times the conductor diameter φd2. This inhibits the occurrence of the defects described above, and, in the case that the lay length P2 is from 7.5 times to 18.2 times the conductor diameter φd2, prevents more reliably the occurrence of the defects described above.

As with No. 4-1 strand test described above, the following was found from No. 4-2 strand test although not described in detail. For the stranded conductor that is formed by performing the inner layer stranding step and thereafter performing the outer layer stranding step, it is suitable to strand the outermost layer onto an inner layer portion having an inner layer lay length P1 from 8.6 times to 22.0 times the inner layer diameter φd1 and more preferably from 12.1 times to 20.7 times the inner layer diameter φd1.

In associations between configurations of this invention and the embodiments described above, softened filaments of this invention correspond to soft filaments 2*a* of the embodiments, and likewise, the unsoftened filaments correspond to hard filaments 2*b*. However, this invention is not intended to be limited to the configurations in the aforementioned embodiments, and many other embodiments can be provided.

For example, according to the descriptions above, the soft filaments 2*a* and the hard filaments 2*b* are formed from a pure aluminum-based material having a composition corresponding to that of JIS H4000 1070 and have a diameter of 0.32 mm. Instead, the soft filaments 2*a* and the hard filaments 2*b* may be, for example, filaments formed from a different pure aluminum-based material or a different aluminum alloy material. The diameter is not limited to 0.32 mm, and, for example, filaments having a diameter within a range from 0.1 mm to 1.1 mm may be used.

In the above embodiments, the soft filaments 2*a* and the hard filaments 2*b* are formed of aluminum filaments having a composition corresponding to that of JIS H4000 1070 and having a diameter of 0.32 mm. The load that the soft filaments 2*a* or the hard filaments 2*b* receive from the applied tension is proportional to the cross-sectional area of the aluminum filaments. Thus, even when the filaments have a diameter in a range from 0.1 mm to 1.1 mm as described above, a preferred tension to be applied can be determined based on the tension to be applied to soft filaments 2*a* or hard filaments 2*b* having a diameter of 0.32 mm. That is, the tension to be applied to, for example, soft filaments 2*a* may be divided by approximately 0.08 $mm^2$, which is a cross-sectional area of, for example, the soft filaments 2*a*. The result value may be used as a reference.

In the description above, the softening step is carried out by exposing the filaments to an elevated temperature of approximately 350° C. for approximately five hours in a state in which the filaments are wound on the bobbins 3*a* or the bobbin 3*b*, but this is not a limitation. The softening step may be carried out by softening the filaments or the stranded conductor in an unwound state.

For the stranded conductor 1*a*, the stranding machine 4*a* illustrated in FIGS. 4 and 5 is used, and the lay length for the second layer 102 and the third layer 103 is 19.4 mm. However, the stranded conductor 1*a* may be stranded not by using the stranding machine 4*a* but, for example, by using the stranding machine 4*c*, illustrated in FIGS. 14 and 15.

Figure 14:
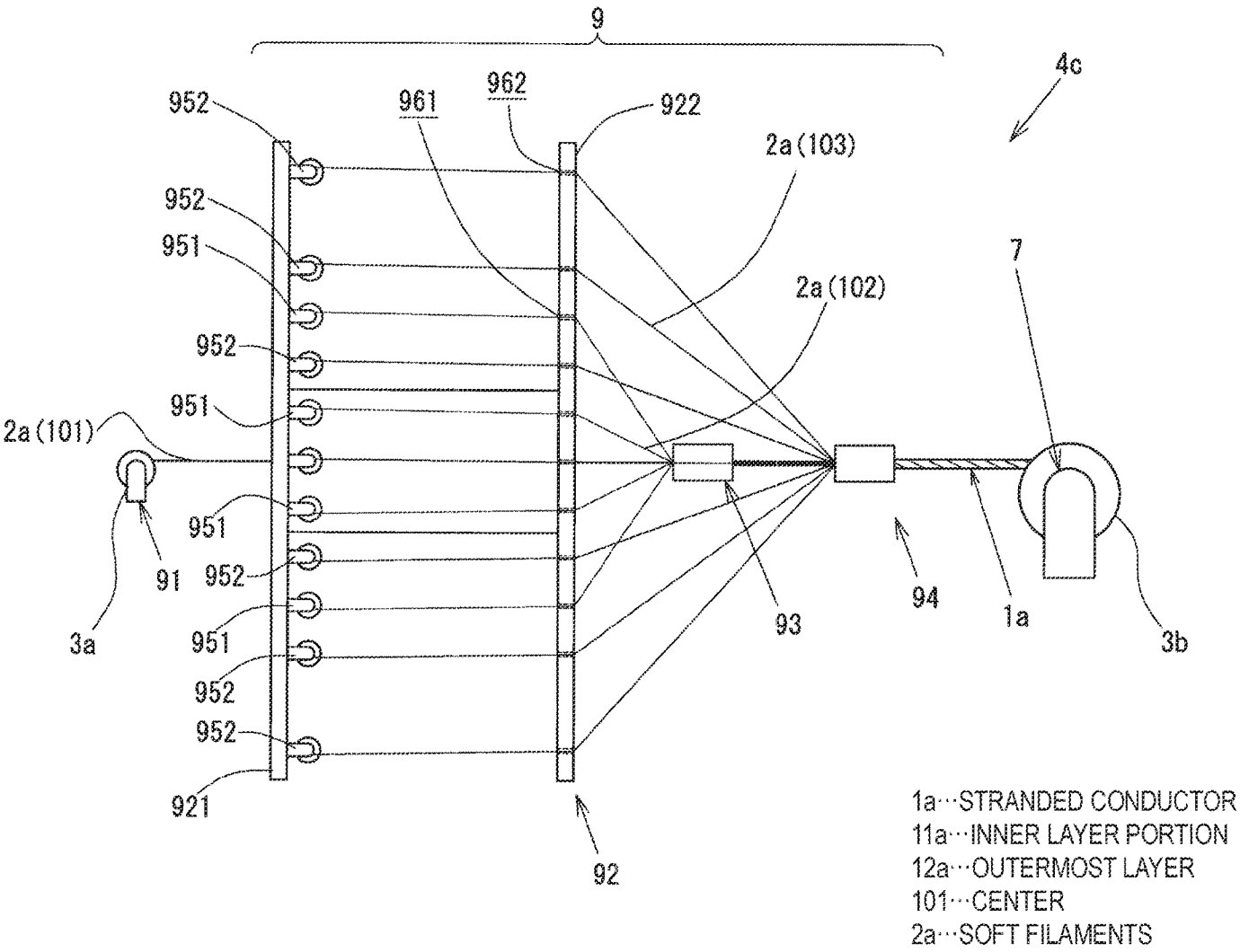
FIG. 14 is a schematic diagram of a stranding machine according to a third embodiment.
Figure 15:
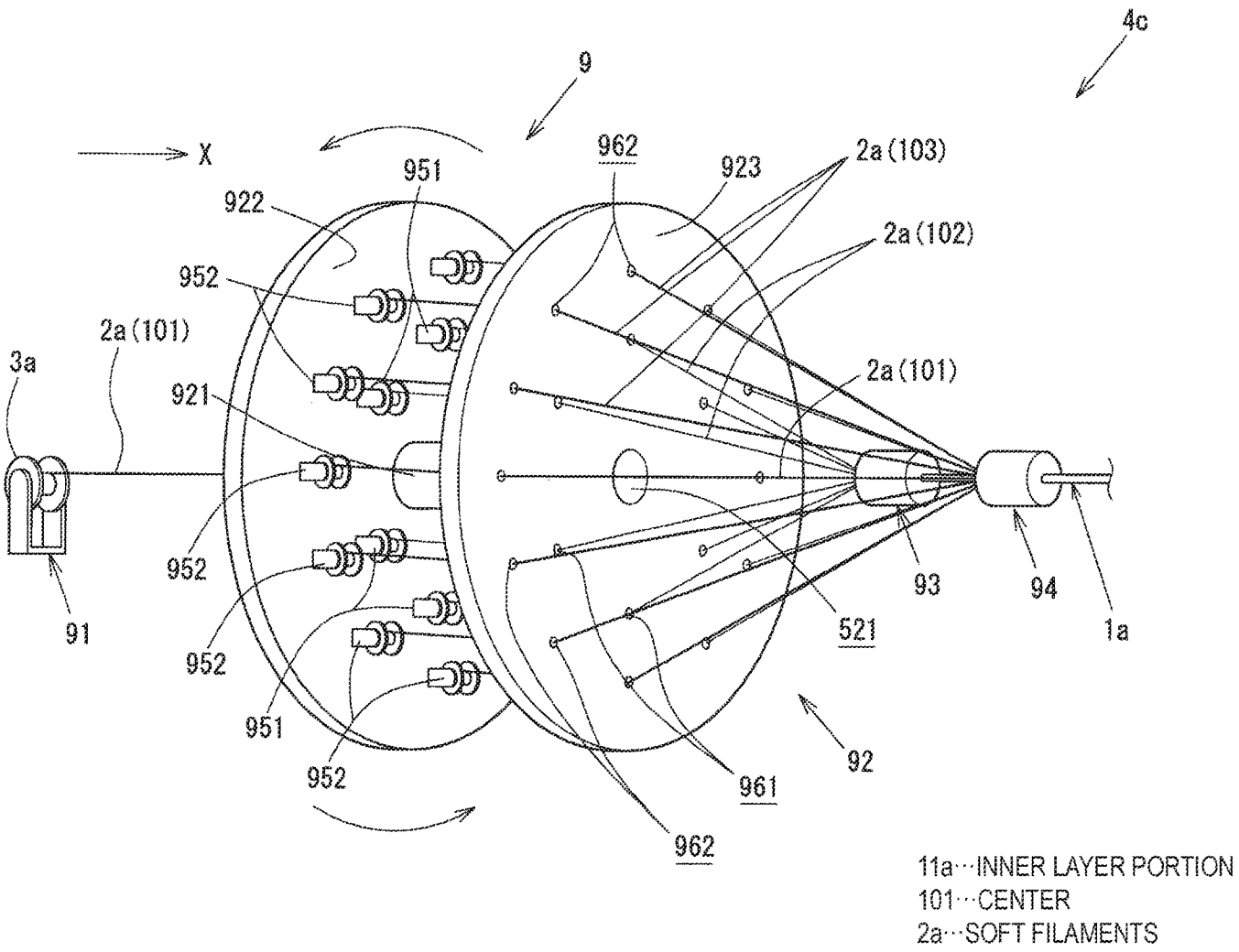
FIG. 15 is an enlarged perspective view of a stranding unit according to the third embodiment.

As illustrated in FIGS. 14 and 15, the stranding machine 4*c* is configured such that the second layer stranding unit 5 for stranding the second layer 102 is combined with the third layer stranding unit 6 for stranding the third layer 103. Thus, stranding of the second layer 102 can be synchronous with stranding of the third layer 103.

The stranding machine 4*c* will be briefly described. The stranding machine 4*c* includes a stranding unit 9 and the conductor coiling unit 7, which are disposed in this order. The stranding unit 9 can simultaneously strand the second layer 102 and the third layer 103 onto the center 101. The conductor coiling unit 7 is used to coil the stranded conductor 1*a*.

The stranding unit 9 is configured such that, in the stranding machine 4*a*, the second layer stranding unit 5 is combined with the third layer stranding unit 6. Specifically, the stranding unit 9 is formed by a first bobbin attachment portion 91, which corresponds to the first bobbin attachment portion 51, a stranding member 92, which corresponds to the second layer stranding member 52 and the third layer stranding member 61, a second layer collect chuck 93, which corresponds to the second layer collect chuck 53, and a third layer collect chuck 94, which corresponds to the third layer collect chuck 62.

The stranding member 92 is integrally formed by an axial core 921, a first flange 922, and a second flange 923. The axial core 921 has a cylindrical shape and extends in the travel direction X. The first flange 922 has a disc shape and is located at the proximal end of the axial core 921, in the travel direction X. The second flange 923 has a disc shape and is located at the distal end in the travel direction X.

The axial core 921 is fitted to a center portion of the first flange 922. The first flange 922 includes six second bobbin attachment portions 951, which are evenly spaced along the same circumference. The second bobbin attachment portions 951 correspond to the second bobbin attachment portions 522. The first flange 922 further includes twelve third bobbin attachment portions 952, which are evenly spaced along the same circumference, radially outside of the second bobbin attachment portions 951. The third bobbin attachment portions 952 correspond to the third bobbin attachment portions 612.

An end of the axial core 921, which has a cylindrical shape and extends in the travel direction X, is fitted to a center portion of the second flange 923. The second flange 923 includes second insertion holes 961 and third insertion holes 962, which are provided in positions where the second insertion holes 961 and the third insertion holes 962 face the second bobbin attachment portions 951 and the third bobbin attachment portions 952, respectively. The second insertion holes 961 correspond to the insertion holes 523 and the third insertion holes 962 correspond to the insertion holes 613.

That is, the second insertion holes 961 are through holes provided in the second flange 923 and are in a substantially regular hexagonal form, and the third insertion holes 962 are through holes provided in the second flange 923 and are in a substantially regular dodecagonal form. The third insertion holes 962 are disposed radially outside of the second insertion holes 961.

The stranded conductor 1*a*, which includes the second layer 102 and the third layer 103 stranded around the center 101, can be manufactured by using the stranding machine 4*c*, configured as described above. The method for manufacture is substantially the same as that for the stranding machine 4*a* and is thus not described.

In the stranding machine 4*c*, the rotational speeds (revolution speeds) of the second bobbin attachment portions 951, the third bobbin attachment portions 952, the second insertion holes 961, and the third insertion holes 962 are the same. Thus, the tensions applied to the soft filaments 2*a* are the same, and the second layer 102 and the third layer 103 are stranded with the same lay length.

Figure 16:
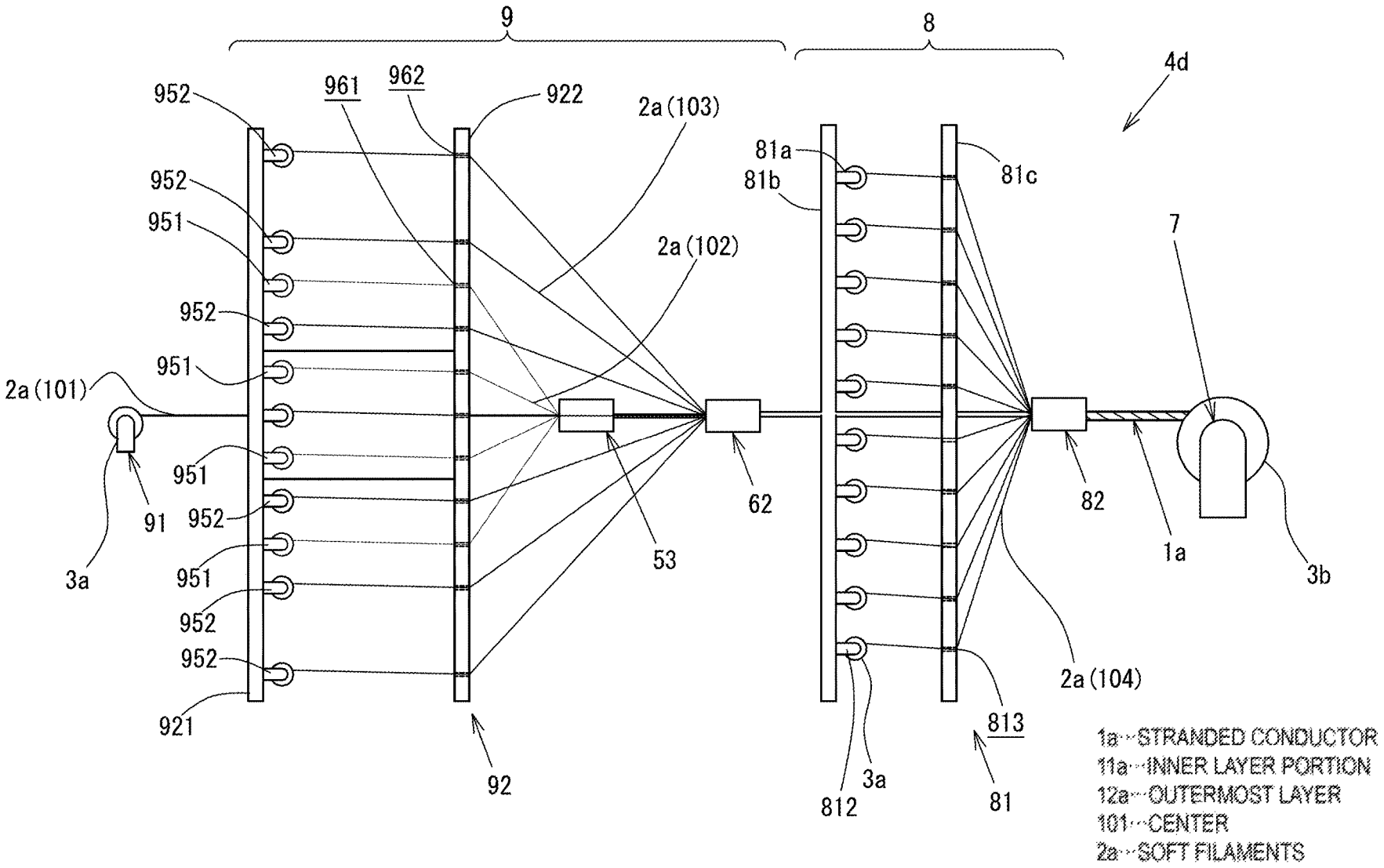
FIG. 16 is a schematic diagram of a stranding machine according to a fourth embodiment.
Figure 17:
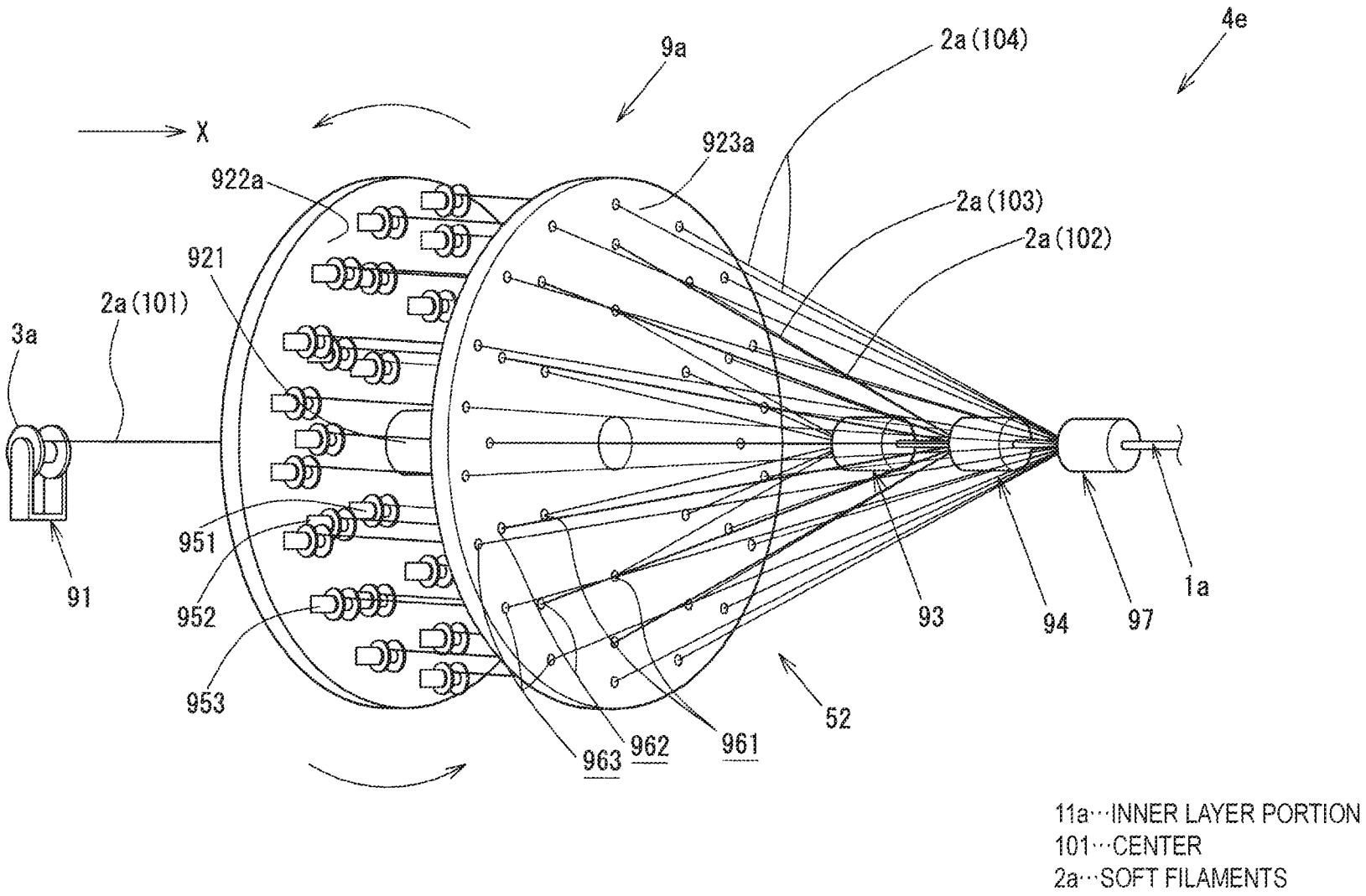
FIG. 17 is an enlarged perspective view of a stranding unit according to a fifth embodiment.

Similarly, the stranded conductor 1*c*, which is composed of four layers, can be manufactured by using a stranding machine 4*d* or a stranding machine 4*e*, illustrated in FIG. 16 or FIG. 17.

As illustrated in FIG. 16, the stranding machine 4*d* is equipment for manufacturing a stranded conductor and includes the stranding unit 9 and the fourth layer stranding unit 8, which are disposed in this order. This configuration enables manufacture of the stranded conductor 1*c*, which is composed of four layers, including the second layer 102 and the third layer 103 stranded with the same lay length.

The stranding machine 4*e*, as illustrated in FIG. 17, is configured such that a stranding unit 9*a* is combined with the conductor coiling unit 7. The stranding unit 9*a* is configured such that the second layer stranding unit 5, the third layer stranding unit 6, and the fourth layer stranding unit 8 are combined with one another.

The stranding unit 9*a* will be briefly described. The stranding unit 9*a* has substantially the same configuration as the stranding unit 9, and thus the same elements are assigned the same reference numerals and descriptions thereof are omitted.

In the stranding unit 9*a*, fourth bobbin attachment portions 953, which correspond to the fourth bobbin attachment portions 812, are provided on a first flange 922*a*, which correspond to the first flange 922, and fourth insertion holes 963, which correspond to insertion holes 813, are provided in a second flange 923*a*, which correspond to the second flange 923. A fourth layer collect chuck 97, which is used to strand the fourth layer 104, is provided closer to the distal end than the third layer collect chuck 94 is, in the travel direction X.

Eighteen fourth bobbin attachment portions 953 are disposed radially outside of the third bobbin attachment portions 952 and are evenly spaced in the form of a concentric circle. Eighteen insertion holes 963 are provided in positions where the insertion holes 963 face the fourth bobbin attachment portions 953.

By using the stranding machine 4*e*, configured as described above, the second layer 102, the third layer 103, and the fourth layer 104 can be stranded with the same lay length, respectively on the center 101, which is the first layer, on the outer periphery of the second layer 102, and on the outer periphery of the third layer 103.

REFERENCE SIGNS LIST

1*a*, 1*b*, 1*c*, 1*d* Stranded conductor
2*a* Soft filament
2*b* Hard filament
3*a*, 3*b* Bobbin
4*a*, 4*b* Stranding machine
11*a*, 11*b*, 11*c*, 11*d* Inner layer portion
12*a*, 12*b*, 12*c*, 12*d* Outermost layer
101 Center
102 Second layer
103 Third layer
104 Fourth layer
φd1 Inner layer diameter
φa, φb, φc, φd2 Conductor diameter
Pa, Pb, Pc Lay length
P1, P3 Inner layer lay length
P2 Outer layer lay length
X Travel direction

The invention claimed is:

1. A stranded conductor, comprising:

a plurality of filaments stranded together such that the plurality of filaments comprises a plurality of softened filaments made of an aluminum material and identical to one another and has a lay length in a range of from 6.2 times to 15.7 times a conductor diameter of the stranded conductor, wherein the plurality of filaments includes a filament disposed along a center of the stranded conductor, six first filaments disposed around the filament and concentrically with the center, twelve second filaments disposed around the six first filaments and concentrically with the center, and eighteen filaments disposed around the twelve second filaments and concentrically with the center such that the first filaments and the second filaments have an equal lay length, and the filament along the center of the stranded conductor, the six first filaments and the twelve second filaments form an inner layer portion, and the eighteen filaments forms an outermost layer disposed outside of and concentrically with the inner layer portion such that the inner layer portion has an inner layer lay length P3 which is determined by Equation (1), $$P3 = \frac{P1 \times P2}{P1 + P2} \quad (1)$$

where P1 represents an inner layer lay length prior to formation of the outermost layer, P2 represents an outer layer lay length, and P3 represents the inner layer lay length in a state in which the outermost layer is formed.

2. The stranded conductor according to claim 1, wherein the plurality of filaments is formed such that the first filaments and the second filaments have the lay length of 6.4 times the conductor diameter of the stranded conductor or greater.

3. The stranded conductor according to claim 2, wherein the six first filaments, the twelve second filaments, and the eighteen filaments have an equal lay length.

4. The stranded conductor according to claim 1, wherein the plurality of filaments is formed such that the lay length is in the range of from 8.7 times to 14.8 times the conductor diameter.

5. The stranded conductor according to claim 4, wherein the six first filaments, the twelve second filaments, and the eighteen filaments have an equal lay length.

6. The stranded conductor according to claim 1, wherein the six first filaments, the twelve second filaments, and the eighteen filaments have an equal lay length.

7. The stranded conductor according to claim 1, wherein the filament along the center of the stranded conductor, the six first filaments and the twelve second filaments form the inner layer portion, and the eighteen filaments form the outermost layer disposed outside of and concentrically with the inner layer portion such that the inner layer portion has the inner layer lay length in a range of from 8.6 times to 22.0 times an inner layer diameter.

8. The stranded conductor according to claim 7, wherein the six first filaments, the twelve second filaments, and the eighteen filaments have an equal lay length.

9. The stranded conductor according to claim 1, wherein the filament along the center of the stranded conductor, the six first filaments and the twelve second filaments form the inner layer portion, and the eighteen filaments form the outermost layer disposed outside of and concentrically with the inner layer portion such that the inner layer portion has the inner layer lay length in a range of from 12.1 times to 20.7 times an inner layer diameter.

10. The stranded conductor according to claim 1, wherein the filament along the center of the stranded conductor, the six first filaments and the twelve second filaments form the inner layer portion, and the eighteen filaments form the outermost layer disposed outside of and concentrically with the inner layer portion such that the inner layer portion has the inner layer lay length in a range of from 8.6 times to 22.0 times an inner layer diameter and that the outermost layer has the outer layer lay length in a range of 6.8 times to 22.7 times the conductor diameter.

11. The stranded conductor according to claim 1, wherein the filament along the center of the stranded conductor, the six first filaments and the twelve second filaments form the inner layer portion, and the eighteen filaments form the outermost layer disposed outside of and concentrically with the inner layer portion such that the inner layer portion has the inner layer lay length in a range of from 12.1 times to 20.7 times an inner layer diameter and that the outermost layer has the outer layer lay length in a range of 7.5 times to 18.2 times the conductor diameter.

12. The method for manufacturing a stranded conductor according to claim 11, wherein the stranding comprises applying a tension in a range of from 1.5 N to 2.5 N to the plurality of filaments.

13. A method for manufacturing a stranded conductor, comprising:

softening a plurality of filaments such that a plurality of softened filaments made of an aluminum material and identical to one another is obtained; and stranding the plurality of filaments such that the plurality of filaments includes a filament disposed along a center of the stranded conductor, six first filaments stranded around and concentrically with the center, twelve second filaments stranded around and concentrically with the center, and eighteen filaments stranded around and concentrically with the center, and has a lay length in a range of from 6.2 times to 15.7 times a conductor diameter of the stranded conductor and that the first filaments and the second filaments have an equal lay length, wherein the filament along the center of the stranded conductor, the six first filaments and the twelve second filaments form an inner layer portion, and the eighteen filaments forms an outermost layer disposed outside of and concentrically with the inner layer portion such that the inner layer portion has an inner layer lay length P3 which is determined by Equation (1), $$P3 = \frac{P1 \times P2}{P1 + P2} \quad (1)$$

where P1 represents an inner layer lay length prior to formation of the outermost layer, P2 represents an outer layer lay length, and P3 represents the inner layer lay length in a state in which the outermost layer is formed.

14. The method for manufacturing a stranded conductor according to claim 12, wherein the stranding comprises applying a tension in a range of from 1.0 N to 4.5 N to the plurality of filaments.

15. The method for manufacturing a stranded conductor according to claim 12, wherein the plurality of filaments is stranded such that the first filaments and the second filaments have the lay length of from 6.4 times the conductor diameter of the stranded conductor and that a tension in a range of from 1.0 N to 7.0 N is applied to the first filaments and the second filaments.

16. The method for manufacturing a stranded conductor according to claim 12, the stranding comprises stranding the inner layer portion, and stranding the outermost layer such that an outer layer lay length of the outermost layer is set to from 6.8 times the conductor diameter and applying a tension in arrange of from 1.0 N to 4.5 N to the filaments and a tension in a range of from 20 N to 150 N to the inner layer portion.

17. The method for manufacturing a stranded conductor according to claim 12, wherein the stranding comprises applying a tension per cross-sectional area in a range of from 12.5 $N/mm^2$ to 56.3 $N/mm^2$ to the filaments.

18. The method for manufacturing a stranded conductor according to claim 12, wherein the stranding comprises applying a tension per cross-sectional area in a range of from 12.5 $N/mm^2$ to 87.5 $N/mm^2$ to the six first filaments and the second twelve filaments.

19. The method for manufacturing a stranded conductor according to claim 17, further comprising:

softening the first six filaments and the second twelve filaments after the stranding of the first six filaments and the second twelve filaments.

20. The method for manufacturing a stranded conductor according to claim 17, wherein the stranding comprises applying a tension per cross-sectional area in a range of from 12.5 $N/mm^2$ to 56.3 $N/mm^2$ to the six first filaments and the second twelve filaments.

* * * * *